US007048515B2

(12) United States Patent
Shimomura et al.

(10) Patent No.: US 7,048,515 B2
(45) Date of Patent: May 23, 2006

(54) HYDRAULIC DRIVE SYSTEM AND METHOD USING A FUEL INJECTION CONTROL UNIT

(75) Inventors: Hirokazu Shimomura, Ibaraki-ken (JP); Tomohiko Yasuda, Kashiwa (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 332 days.

(21) Appl. No.: 10/344,120

(22) PCT Filed: Jun. 20, 2002

(86) PCT No.: PCT/JP02/06138

§ 371 (c)(1),
(2), (4) Date: Feb. 7, 2003

(87) PCT Pub. No.: WO03/001067

PCT Pub. Date: Jan. 3, 2003

(65) Prior Publication Data

US 2003/0156949 A1 Aug. 21, 2003

(30) Foreign Application Priority Data

Jun. 21, 2001 (JP) ..... 2001-188357
Jan. 23, 2002 (JP) ..... 2002-14357

(51) Int. Cl.
*F04B 49/08* (2006.01)

(52) U.S. Cl. ..... 417/213; 417/279; 417/374; 417/222.1; 60/452; 123/357

(58) Field of Classification Search ..... 417/279, 417/213, 374, 222.1; 60/452; 123/357
See application file for complete search history.

(56) References Cited

U.S. PATENT DOCUMENTS 3,772,884 A * 11/1973 Witt ..... 60/701
3,818,883 A * 6/1974 Glassey ..... 123/383
4,077,744 A 3/1978 Pensa
4,343,276 A * 8/1982 Jaliwala et al. ..... 123/383
4,349,744 A * 9/1982 Reuther et al. ..... 290/40 C
4,600,364 A * 7/1986 Nakatani et al. ..... 417/216
5,267,441 A * 12/1993 Devier et al. ..... 60/452
5,586,869 A * 12/1996 Benckert et al. ..... 417/218
6,623,247 B1 * 9/2003 Du ..... 417/53
2003/0206805 A1 * 11/2003 Bishop et al. ..... 417/44.2

FOREIGN PATENT DOCUMENTS

| | | |
|---|---|---|
| JP | 51-109504 | 8/1976 |
| JP | 5-248401 | 9/1993 |
| JP | 7-83084 | 3/1995 |
| JP | 10-89111 | 4/1998 |
| JP | 10-159599 | 6/1998 |
| JP | 11-50868 | 2/1999 |

* cited by examiner

*Primary Examiner*—Cheryl Tyler
*Assistant Examiner*—Emmanuel Sayoc
(74) *Attorney, Agent, or Firm*—Mattingly, Stanger, Malur & Brundidge, P.C.

(57) ABSTRACT

A fuel injection control unit, including an electronic governor and a controller for an engine performs control in a governor region based on an isochronous characteristic. A working machine controller receives a delivery pressure signal P and controls a regulator such that, when the delivery pressure of a hydraulic pump exceeds a predetermined pressure P1, the displacement of the hydraulic pump does not exceed a value decided in accordance with a preset pump absorption torque curve. The working machine controller controls the regulator such that, when the delivery pressure of the hydraulic pump 2 is not higher than the predetermined pressure P1, the displacement of the hydraulic pump is increased as the delivery pressure of the hydraulic pump lowers from the predetermined pressure P1.

20 Claims, 19 Drawing Sheets

HYDRAULIC DRIVE SYSTEM AND METHOD USING A FUEL INJECTION CONTROL UNIT

TECHNICAL FIELD

The present invention relates to a hydraulic drive system and a hydraulic drive method for use in a working machine, such as a hydraulic excavator, which comprises an engine including a fuel injection control unit capable of performing control in a governor region based on an isochronous characteristic or a reverse drooping characteristic, and a variable displacement hydraulic pump driven by the engine.

BACKGROUND ART

Hitherto, a hydraulic drive system for a working machine including a mechanical governor-equipped engine has been proposed as disclosed in, e.g., JP, A 7-83084.

A prior-art system including that type of mechanical governor-equipped engine generally comprises a variable displacement hydraulic pump driven by the engine, a regulator for controlling the displacement of the hydraulic pump, a plurality of hydraulic actuators driven by a hydraulic fluid delivered from the hydraulic pump, a pressure sensor for detecting the delivery pressure of the hydraulic pump and outputting a delivery pressure signal, and a controller for receiving the delivery pressure signal outputted from the pressure sensor and outputting, to the regulator, a control signal to control the displacement of the hydraulic pump.

In the prior-art system including the mechanical governor-equipped engine, an engine output characteristic has, in a governor region where a mechanical governor performs control, a drooping characteristic that the engine revolution speed increases as the engine output torque (engine load) reduces. Such a drooping characteristic is produced by the inertia of a flywheel contained in the mechanical governor.

In the case of the working machine being, e.g., a hydraulic excavator, therefore, in a no-load operation after loading earth and sand, etc. in a bucket and then unloading them, the delivery pressure of the hydraulic pump lowers and the engine load reduces, whereby the engine revolution speed increases. This further increases the delivery rate of the hydraulic pump and hence the flow rate of the hydraulic fluid supplied to the hydraulic actuators so that the hydraulic actuators can be operated at relatively high speeds. As a result, the working speed in the no-load operation can be increased and the working efficiency can be improved.

Also, as disclosed in JP, A 10-89111 and JP, A 10-159599, for example, there is conventionally known a hydraulic drive system for a working machine including, instead of the mechanical governor-equipped engine described above, an engine including a fuel injection control unit capable of performing control in a governor region based on an isochronous characteristic or a reverse drooping characteristic (also referred to as an "engine performing isochronous control or reverse drooping control" hereinafter). The isochronous characteristic in engine control means a characteristic that the engine revolution speed is kept constant in the governor region regardless of the magnitude of the engine load, i.e., regardless of a reduction of the engine output torque. The reverse drooping characteristic means a characteristic that the engine revolution speed is reduced as the engine output torque (engine load) decreases.

With that prior-art system, it is possible to prevent the effect due to the inertia of the flywheel as encountered in the mechanical governor, and to realize lower fuel consumption and less noise than those in a working machine including an engine equipped with a mechanical governor.

DISCLOSURE OF THE INVENTION

The working machine including the engine performing isochronous control or reverse drooping control is advantageous in realizing lower fuel consumption and less noise as described above, but may cause a problem in work because the engine revolution speed is not increased even when the engine load is small. Assuming, for example, that the working machine is a hydraulic excavator as mentioned above, even at a small engine load in the no-load operation, the engine revolution speed is not increased and therefore the delivery rate of the hydraulic pump is also not increased. Consequently, the flow rate of the hydraulic fluid supplied to the hydraulic actuators cannot be increased and an improvement of the working efficiency is not expected.

Also, in work carried out with the engine performing isochronous control or reverse drooping control, an operator, who has been well experienced in operation of the working machine including the mechanical governor-equipped engine, may have an unusual operation feeling because the hydraulic actuator speed is not increased, unlike the working machine including the mechanical governor-equipped engine, in spite of the engine load being small.

An object of the present invention is to improve a hydraulic drive system equipped with an engine including a fuel injection control unit capable of performing control in at least a part of a governor region based on an isochronous characteristic or a reverse drooping characteristic, and to provide a hydraulic drive system and a hydraulic drive method for a working machine, in which the delivery rate of a hydraulic pump can be increased even in the governor region as an engine load reduces.

(1) To achieve the above object, the present invention provides a hydraulic drive system for a working machine comprising an engine having a fuel injection control unit capable of performing control in at least a part of a governor region based on an isochronous characteristic, a reverse drooping characteristic, or a combined one of the isochronous characteristic and the reverse drooping characteristic; a variable displacement hydraulic pump driven by the engine; and a plurality of hydraulic actuators driven by a hydraulic fluid delivered from the hydraulic pump, wherein the hydraulic drive system comprises pump absorption torque control means for controlling a displacement of the hydraulic pump such that, when a delivery pressure of the hydraulic pump exceeds a first predetermined pressure, the displacement of the hydraulic pump does not exceed a value decided in accordance with a preset pump absorption torque curve; and flow rate compensation control means for controlling the displacement of the hydraulic pump such that, when the delivery pressure of the hydraulic pump is not higher than the first predetermined pressure, the displacement of the hydraulic pump is increased as the delivery pressure of the hydraulic pump lowers from a second predetermined pressure.

With the present invention constituted as set forth above, when the engine load during work is large and the delivery pressure of the hydraulic pump is higher than the first predetermined pressure, engine output horsepower can be effectively utilized with pump absorption torque control (pump absorption horsepower control). Also, when the engine load is changed, for example, from a large one to a small one and the delivery pressure of the hydraulic pump becomes not higher than the second predetermined pressure, the flow rate compensation control means controls the displacement of the hydraulic pump to be increased as the pump delivery pressure lowers. In spite of the engine revolution speed being not increased in the governor region due to the isochronous characteristic or the reverse drooping characteristic, therefore, the delivery rate of the hydraulic pump can be increased in the governor region and hence the hydraulic actuator speed can be increased when the engine load is small.

(2) Also, to achieve the above object, the present invention provides a hydraulic drive system for a working machine comprising an engine having a fuel injection control unit capable of performing control in at least a part of a governor region based on an isochronous characteristic, a reverse drooping characteristic, or a combined one of the isochronous characteristic and the reverse drooping characteristic; a variable displacement hydraulic pump driven by the engine; and a plurality of hydraulic actuators driven by a hydraulic fluid delivered from the hydraulic pump, wherein the hydraulic drive system comprises a regulator for controlling a displacement of the hydraulic pump; a pressure sensor for detecting a delivery pressure of the hydraulic pump; pump absorption torque control means for controlling the regulator such that, when the delivery pressure of the hydraulic pump detected by the pressure sensor exceeds a first predetermined pressure, the displacement of the hydraulic pump does not exceed a value decided in accordance with a preset pump absorption torque curve; and flow rate compensation control means for controlling the regulator such that, when the delivery pressure of the hydraulic pump is not higher than the first predetermined pressure, the displacement of the hydraulic pump is increased as the delivery pressure of the hydraulic pump lowers from a second predetermined pressure.

With the present invention constituted as set forth above, similarly to the above (1), effective utilization of engine output horsepower with pump absorption torque control (pump absorption horsepower control) and the control for increasing the pump delivery rate at a small engine load can be both realized. Hence, the hydraulic actuator speed can be increased when the engine load is small.

(3) In the above (1) or (2), preferably, the second predetermined pressure is matched with the first predetermined pressure.

With that feature, when the delivery pressure of the hydraulic pump becomes not higher than the first predetermined pressure, the function of the flow rate compensation control means is started at once so that the displacement of the hydraulic pump can be increased.

(4) In the above (1) or (2), preferably, the hydraulic drive system further comprises control release means for making ineffective the control for increasing the displacement of the hydraulic pump executed by the flow rate compensation control means.

With that feature, the control executed by the flow rate compensation control means can be released as required, and therefore the flow rate control depending on the type of work can be realized.

(5) In the above (4), preferably, the fuel injection control unit is capable of performing control in at least a part of the governor region based on the isochronous characteristic, and the control release means includes at least one of a travel mode switch, a load lifting mode switch, and a ground leveling mode switch.

With those features, in the case of performing the operation or work, such as traveling, load lifting or ground leveling, in which it is not desired to perform the control for increasing the delivery rate of the hydraulic pump, the hydraulic actuator can be operated at a constant speed in spite of an increase or decrease of the engine load. As a result, the traveling operation, the load lifting work and the ground leveling work can be satisfactorily performed.

(6) In the above (1) or (2), preferably, the flow rate compensation control means controls the displacement of the hydraulic pump such that the delivery rate of the hydraulic pump is increased as the delivery pressure of the hydraulic pump lowers from the second predetermined pressure.

With that feature, as described in the above (1), the delivery rate of the hydraulic pump can be increased in the governor region in spite of the engine revolution speed being not increased due to the isochronous characteristic or the reverse drooping characteristic.

(7) In the above (1) or (2), preferably, the fuel injection control unit is capable of performing control in at least a part of the governor region based on the reverse drooping characteristic, and the flow rate compensation control means comprises first means for controlling the displacement of the hydraulic pump such that the delivery rate of the hydraulic pump is increased as the delivery pressure of the hydraulic pump lowers from the second predetermined pressure, second means for controlling the displacement of the hydraulic pump such that the delivery rate of the hydraulic pump is held constant when the delivery pressure of the hydraulic pump lowers from the second predetermined pressure, and selecting means for selecting one of the first means and the second means.

With those features, regardless of the characteristic in the governor region, the delivery rate of the hydraulic pump is controlled to be increased when the first means is selected, and the delivery rate of the hydraulic pump is controlled to be held constant when the second means is selected. As a result, the flow rate control depending on the type of work can be realized.

(8) In the above (7), preferably, the flow rate compensation control means further comprises third means for making ineffective the control for increasing the displacement of the hydraulic pump, and the selecting means selects one of the first means, the second means and the third means.

With those features, when the third means is selected, the control for increasing the displacement of the hydraulic pump is made ineffective. Therefore, the flow rate control depending on the type of work can be realized.

(9) In the above (1) or (2), preferably, the pump absorption torque control means has means for computing a target displacement for pump absorption torque control from the delivery pressure of the hydraulic pump and the pump absorption torque curve, and holding the target displacement at a constant value when the delivery pressure of the hydraulic pump is not higher than the first predetermined pressure, and the flow rate compensation control means comprises means for computing a displacement modification value that is increased as the delivery pressure of the hydraulic pump lowers from the second predetermined pressure, and means for computing a modified second displacement by adding the displacement modification value to the target displacement, the displacement of the hydraulic pump being controlled in accordance with the modified target displacement.

With those features, the pump absorption torque control means and the flow rate compensation control means can be constituted using a computer.

(10) In the above (1) or (2), preferably, the pump absorption torque control means is means for limiting a maximum value of the displacement of the hydraulic pump to be not larger than the value decided in accordance with the pump absorption torque curve, and the flow rate compensation control means is means for controlling the maximum value of the displacement of the hydraulic pump such that the maximum value is increased as the delivery pressure of the hydraulic pump lowers from the second predetermined pressure.

With those features, as described in the above (1), effective utilization of engine output horsepower with pump absorption torque control (pump absorption horsepower control) and the control for increasing the pump delivery rate at a small engine load can be realized. In addition, when demanded flow rates of the plurality of actuators are small, the displacement of the hydraulic pump is controlled correspondingly so that desired actuator speeds can be obtained.

(11) In the above (1) or (2), preferably, the hydraulic drive system further comprises first computing means for computing a first target displacement depending on demanded flow rates of the plurality of hydraulic actuators, wherein the pump absorption torque control means has second computing means for computing a second target displacement for pump absorption torque control from the delivery pressure of the hydraulic pump and the pump absorption torque curve, and holding the target displacement at a constant value when the delivery pressure of the hydraulic pump is not higher than the first predetermined pressure, and the flow rate compensation control means comprises means for computing a displacement modification value that is increased as the delivery pressure of the hydraulic pump lowers from the second predetermined pressure, and means for computing a modified second target displacement by adding the displacement modification value to the second target displacement, the displacement of the hydraulic pump being controlled by selecting smaller one of the first target displacement and the modified second target displacement as a target displacement for control.

With those features, when the first target displacement depending on the demanded flow rates of the plurality of hydraulic actuators is larger than the modified second target displacement, the modified second target displacement is selected as the target displacement for control, and the displacement of the hydraulic pump is limited to the modified second target displacement. Accordingly, as described in the above (1), effective utilization of engine output horsepower with pump absorption torque control (pump absorption horsepower control) and the control for increasing the pump delivery rate at a small engine load can be both realized. On the other hand, when the first target displacement is smaller than the modified second target displacement, the first target displacement is selected as the target displacement for control and the displacement of the hydraulic pump is controlled depending on the demanded flow rates in accordance with the first target displacement. Hence, desired actuator speeds can be obtained.

(12) Further, to achieve the above object, the present invention provides a hydraulic drive method for a working machine comprising an engine having a fuel injection control unit capable of performing control in at least a part of a governor region based on an isochronous characteristic, a reverse drooping characteristic, or a combined one of the isochronous characteristic and the reverse drooping characteristic; a variable displacement hydraulic pump driven by the engine; and a plurality of hydraulic actuators driven by a hydraulic fluid delivered from the hydraulic pump, wherein when a delivery pressure of the hydraulic pump exceeds a first predetermined pressure, a displacement of the hydraulic pump is controlled such that the displacement of the hydraulic pump does not exceed a value decided in accordance with a preset pump absorption torque curve, and when the delivery pressure of the hydraulic pump is not higher than the first predetermined pressure, the displacement of the hydraulic pump is controlled such that the displacement of the hydraulic pump is increased as the delivery pressure of the hydraulic pump lowers from a second predetermined pressure.

With those features, as described in the above (1), effective utilization of engine output horsepower with pump absorption torque control (pump absorption horsepower control) and the control for increasing the pump delivery rate at a small engine load can be both realized. Hence, the hydraulic actuator speed can be increased when the engine load is small.

(13) In the above (12), preferably, when the delivery pressure of the hydraulic pump is not higher than the first predetermined pressure, one of the control for increasing the displacement of the hydraulic pump as the delivery pressure of the hydraulic pump lowers from the second predetermined pressure and control for holding the displacement of the hydraulic pump constant is selectable.

With that feature, the control for increasing the pump displacement can be released as required, and therefore the flow rate control depending on the type of work can be realized.

(14) In the above (12), preferably, when the delivery pressure of the hydraulic pump is not higher than the first predetermined pressure, the displacement of the hydraulic pump is controlled such that a delivery rate of the hydraulic pump is increased as the delivery pressure of the hydraulic pump lowers from the second predetermined pressure.

With that feature, as described in the above (1), the delivery rate of the hydraulic pump can be increased in the governor region in spite of the engine revolution speed being not increased due to the isochronous characteristic or the reverse drooping characteristic.

(15) In the above (12), preferably, the fuel injection control unit is capable of performing control in at least a part of the governor region based on the reverse drooping characteristic, and when the delivery pressure of the hydraulic pump is not higher than the first predetermined pressure, one of the control for increasing the displacement of the hydraulic pump such that the delivery rate of the hydraulic pump is increased as the delivery pressure of the hydraulic pump lowers from the second predetermined pressure, and control for increasing the displacement of the hydraulic pump such that the delivery rate of the hydraulic pump is held constant as the delivery pressure of the hydraulic pump lowers from the second predetermined pressure is selectable.

With those features, regardless of the characteristic in the governor region, the flow rate control depending on the type of work can be realized.

BEST MODE FOR CARRYING OUT THE INVENTION

Embodiments of the present invention will be described below with reference to the drawings.

Figure 1:
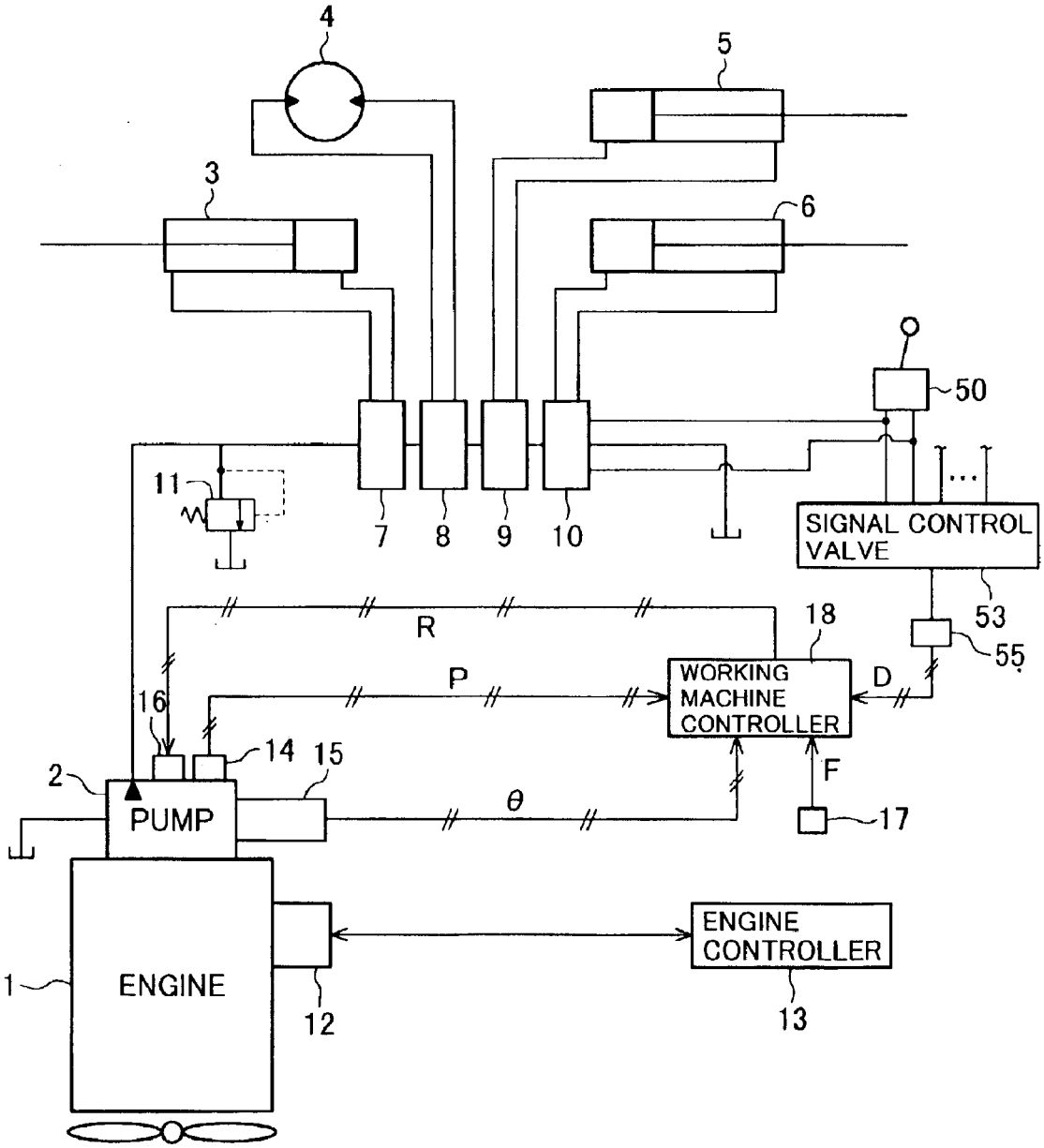
FIG. 1 is a block diagram showing the entirety of a hydraulic drive system for a working machine according to a first embodiment of the present invention, including a hydraulic circuit.

FIG. 1 is a block diagram showing the entirety of a hydraulic drive system for a working machine according to one embodiment of the present invention, including a hydraulic circuit.

The hydraulic drive system according to this embodiment is equipped in a working machine such as a hydraulic excavator and comprises, as shown in FIG. 1, an engine 1, an electronic governor 12 and an engine controller 13, the latter two 12, 13 constituting a fuel injection control unit for the engine 1. The electronic governor 12 and the engine controller 13 are able to control a governor region based on an isochronous characteristic, i.e., to perform isochronous control in a governor region such that the revolution speed of the engine 1 is maintained at a rated speed regardless of an increase and decrease of the engine load. The electronic governor 12 is controlled by the engine controller 13 for injection of fuel into the engine 1. That type of fuel injection control unit is well known as disclosed in, e.g., JP, A 10-159599.

The hydraulic drive system according to this embodiment further comprises, as shown in FIG. 1, a variable displacement hydraulic pump 2 of swash plate type, for example, which is driven by the engine 1; a regulator 16 for controlling the displacement (swash-plate tilting angle) of the hydraulic pump 2; a plurality of hydraulic actuators, such as a hydraulic cylinder 3, a hydraulic motor 4 and hydraulic cylinders 5, 6, driven by a hydraulic fluid delivered from the hydraulic pump 2; directional control valves 7 to 10 for controlling respective flows of the hydraulic fluid supplied to the hydraulic actuators; a main relief valve 11; control lever devices 50, . . . (only one of which is shown) for generating pilot pressures to shift the directional control valves 7 to 10; a pressure sensor 14 for detecting a delivery pressure of the hydraulic pump 2 and outputting a delivery pressure signal P; a tilting angle sensor 15 for detecting the swash-plate tilting angle (displacement) of the hydraulic pump 2 and outputting a tilting angle signal θ; a mode selection switch 17 capable of outputting a control release signal F; a signal control valve 53 in combination of shuttle valves for receiving the pilot pressures from the control lever devices 50, . . . and selecting and outputting one of the received pilot pressures; a pressure sensor 55 for detecting the pilot pressure outputted from the signal control valve 53 and outputting a pilot pressure signal D; and a working machine controller 18 for receiving the delivery pressure signal P outputted from the pressure sensor 14, the tilting angle signal θ outputted from the tilting angle sensor 15, the control release signal F outputted from the mode selection switch 17, and the pilot pressure signal D outputted from the pressure sensor 55, and then outputting, to the regulator 16, a control current signal R to control the pump displacement.

Figure 2:
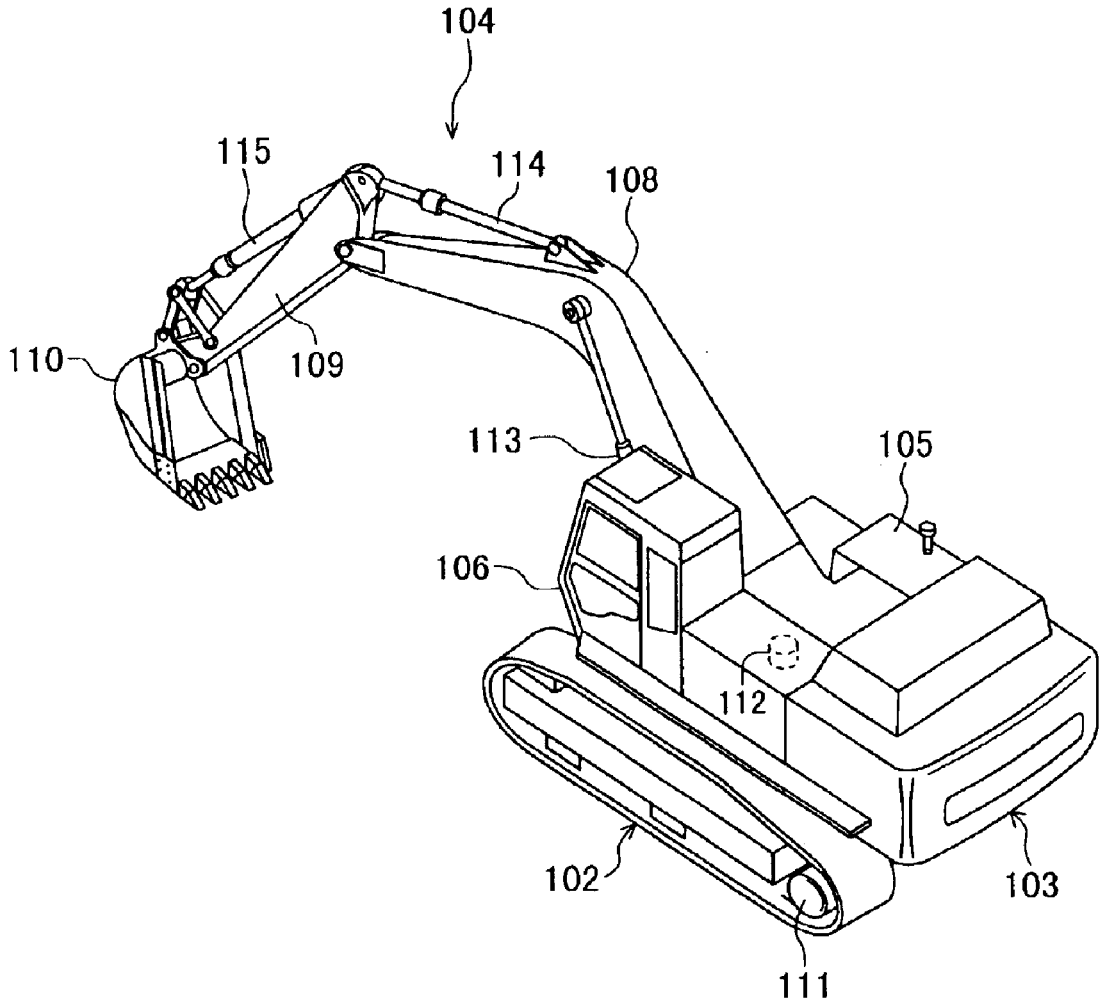
FIG. 2 is a view showing an external appearance of a hydraulic excavator in which the hydraulic drive system according to the first embodiment is mounted.

FIG. 2 shows an external appearance of a hydraulic excavator in which the hydraulic drive system according to this embodiment is mounted.

The hydraulic excavator comprises a lower track structure 102, an upper swing structure 103, and a front working device 104. The upper swing structure 103 is mounted to an upper portion of the lower track structure 102 in a swingable manner, and the front working device 104 is attached to a front portion of the upper swing structure 103 in a vertically rotatable manner. An engine room 105 and a cab 106 are provided on the upper swing structure 103. The front working device 104 is of a multi-articulated structure comprising a boom 108, an arm 109 and a bucket 110. The lower track structure 102, the upper swing structure 103, and the front working device 104 include, as actuators, left and right track motors 111 (only one of which is shown), a swing motor 112, a boom cylinder 113, an arm cylinder 114, and a bucket cylinder 115. The lower track structure 102 travels with rotation of the left and right track motors 111, and the upper swing structure 103 swings with rotation of the swing motor 112. The boom 108 of the front working device 104 rotates in the vertical direction with extension and contraction of the boom cylinder 113, the arm 109 rotates in the vertical and back-and-forth directions with extension and contraction of the arm cylinder 114, and the bucket 110 rotates in the vertical and back-and-forth directions with extension and contraction of the bucket cylinder 115.

The hydraulic cylinders 3, 5 and 6 and the hydraulic motor 4, shown in FIG. 1, represent the above-mentioned actuators. For example, the hydraulic cylinders 3, 5 and 6 correspond to the boom cylinder 113, the arm cylinder 114, and the bucket cylinder 115, and the hydraulic motor 4 corresponds to the swing motor 112, respectively.

Also, the control lever devices 50, . . . and the mode selection switch 17 are disposed in the cab 106, and the engine 1 and the hydraulic pump 2 are disposed in the engine room 105. Hydraulic equipment and electronic equipment, such as the directional control valves 7–10, the engine controller 13, and the working machine controller 18, are installed at appropriate positions of the upper swing structure 103.

Figure 3:
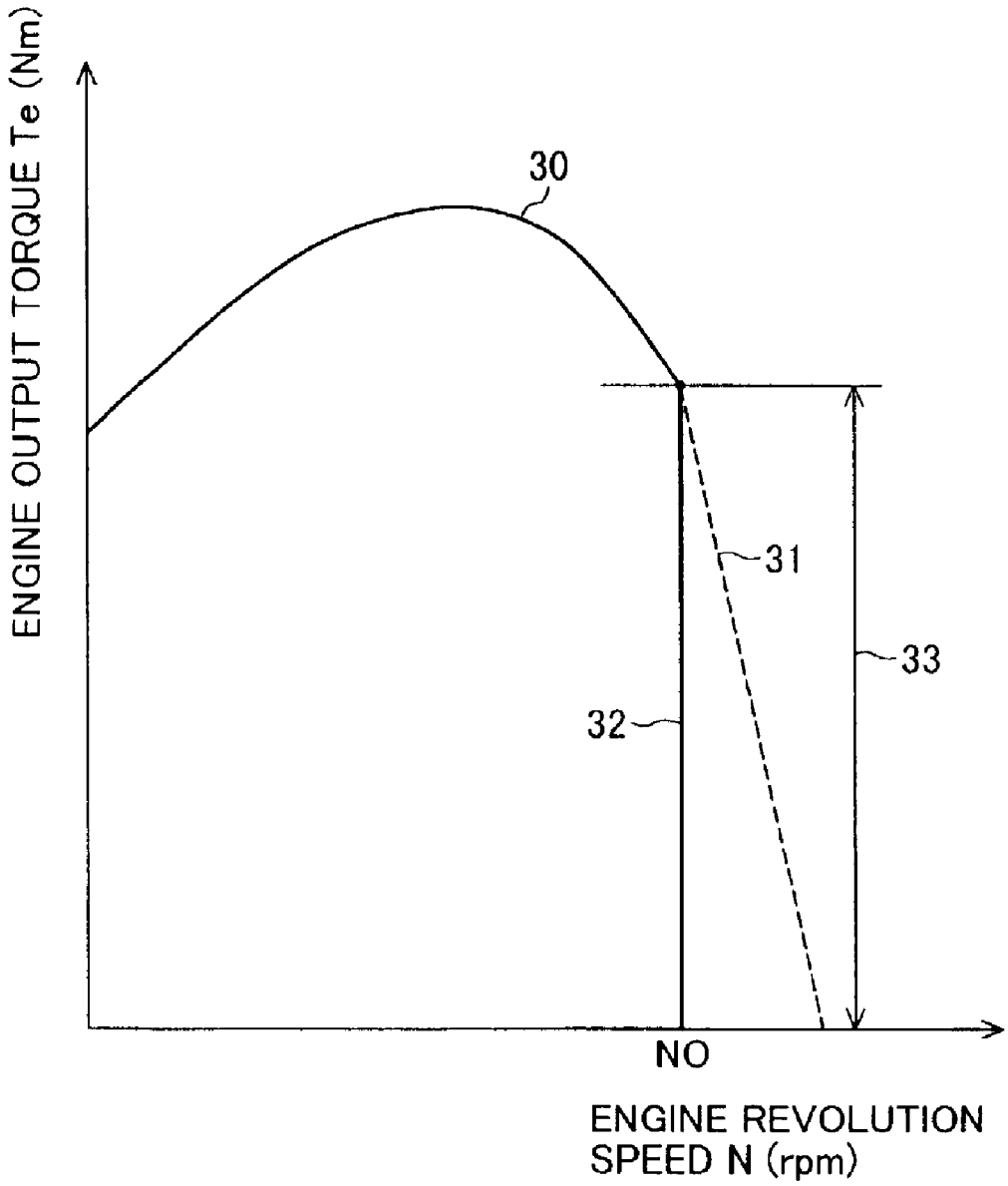
FIG. 3 is a characteristic graph showing the relationship between a revolution speed and an output torque of an engine equipped with an electronic governor performing isochronous control.

FIG. 3 shows the relationship between a revolution speed N and an output torque Te of the engine 1 based on the fuel injection control unit (the electronic governor 12 and the engine controller 13) performing isochronous control.

An output torque characteristic of the engine 1 is divided, as shown in FIG. 3, into a characteristic (isochronous characteristic) in a governor region 33 represented by a straight line 32 and a characteristic in a full-load region represented by a curved line 30. The governor region 33 means an output region in which the opening degree of the governor is less than 100%, and the full-load region means an output region in which the opening degree of the governor is 100%. In FIG. 3, a broken line 31 represents, for comparison, a characteristic (drooping characteristic) in a governor region of a conventional mechanical governor-equipped engine. A mechanical governor is of a structure for adjusting the amount of injected fuel based on a balance between a flywheel and a spring. As represented by the broken line 31, the governor region of the mechanical governor-equipped engine has a drooping characteristic that the engine revolution speed N is increased as the engine output torque (engine load) Te decreases. In contrast, the engine 1 of this embodiment has an isochronous characteristic in the governor region where isochronous control is performed such that, as represented by the straight line 32, the engine revolution speed N is held constant at a rated speed NO by the electronic governor 12 regardless of a reduction of the engine output torque Te. With that isochronous control, this embodiment can realize lower fuel consumption and less noise than those in the working machine including the mechanical governor-equipped engine.

Figure 4:
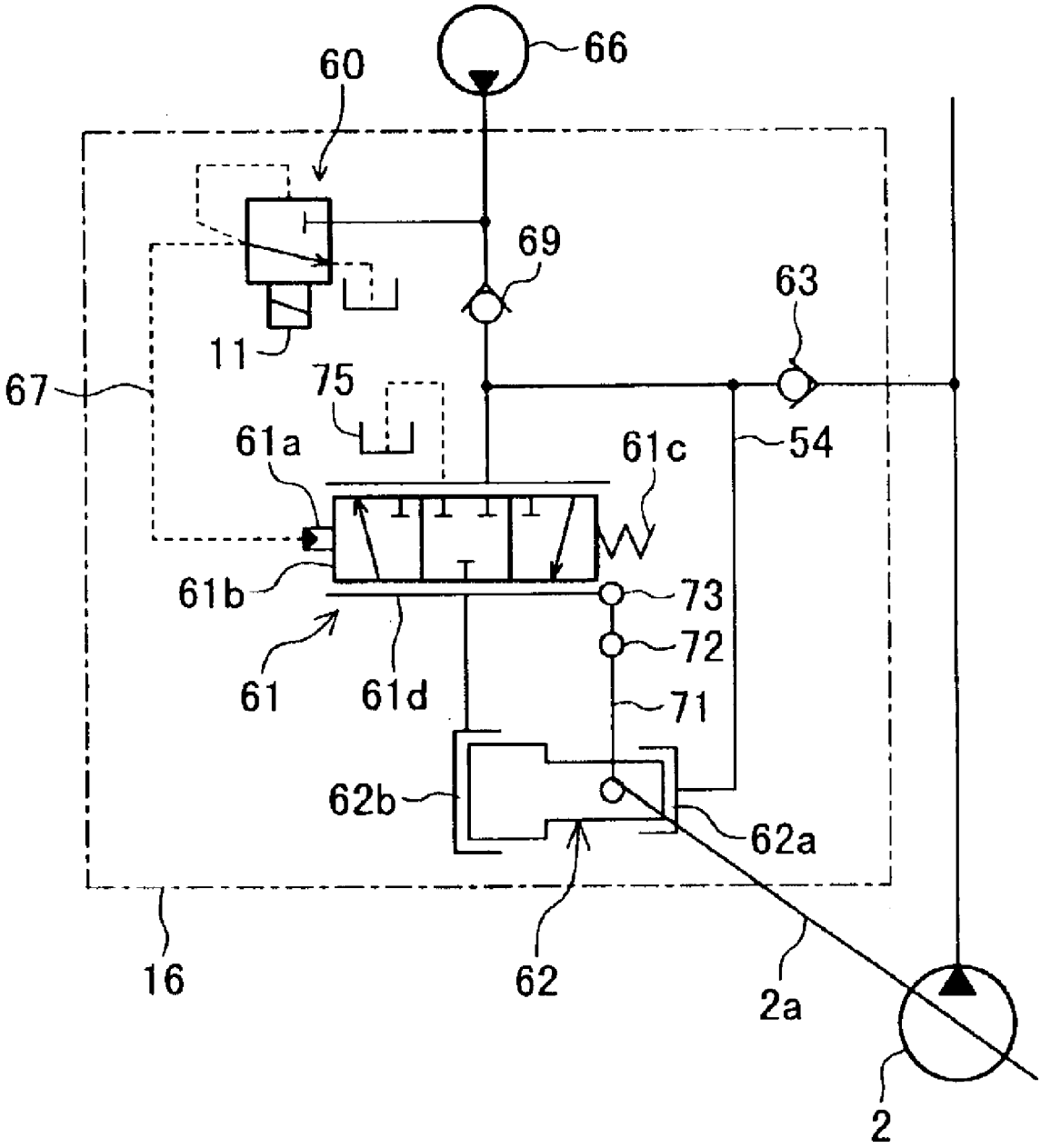
FIG. 4 is a diagram showing details of a structure of a regulator.

FIG. 4 shows a detailed structure of the regulator 16. The regulator 16 controls, in accordance with the control current signal R outputted from the working machine controller 18, the tilting angle of the hydraulic pump 2 to be matched with a target pump tilting angle indicated by the control current signal R. The regulator 16 comprises a solenoid proportional pressure-reducing valve 60, a servo valve 61, and a servo piston 62. The solenoid proportional pressure-reducing valve 60 receives the control current signal R from the working machine controller 18 and outputs a control pressure proportional to the received control current signal R. The servo valve 61 is operated by the outputted control pressure and controls a position of the servo piston 62. The servo piston 62 drives a swash plate 2*a* of the hydraulic pump 2 and controls the tilting angle of the swash plate 2*a*.

The delivery pressure of the hydraulic pump 2 is introduced to an input port of the servo valve 61 through a check valve 63 and also acts upon a smaller-diameter chamber 62*a* of the servo piston 62 through a passage 54 at all times. The delivery pressure of a pilot pump 66 is introduced to an input port of the solenoid proportional pressure-reducing valve 60 and then becomes the control pressure after being reduced with operation of the solenoid proportional pressure-reducing valve 60. The control pressure thus produced acts upon a pilot piston 61*a* of the servo valve 61 through a passage 67. Also, when the delivery pressure of the hydraulic pump 2 is lower than the delivery pressure of the pilot pump 66, the delivery pressure of the pilot pump 66 is introduced as a servo assist pressure to an input port of the servo valve 61 through a check valve 69.

Figure 5:
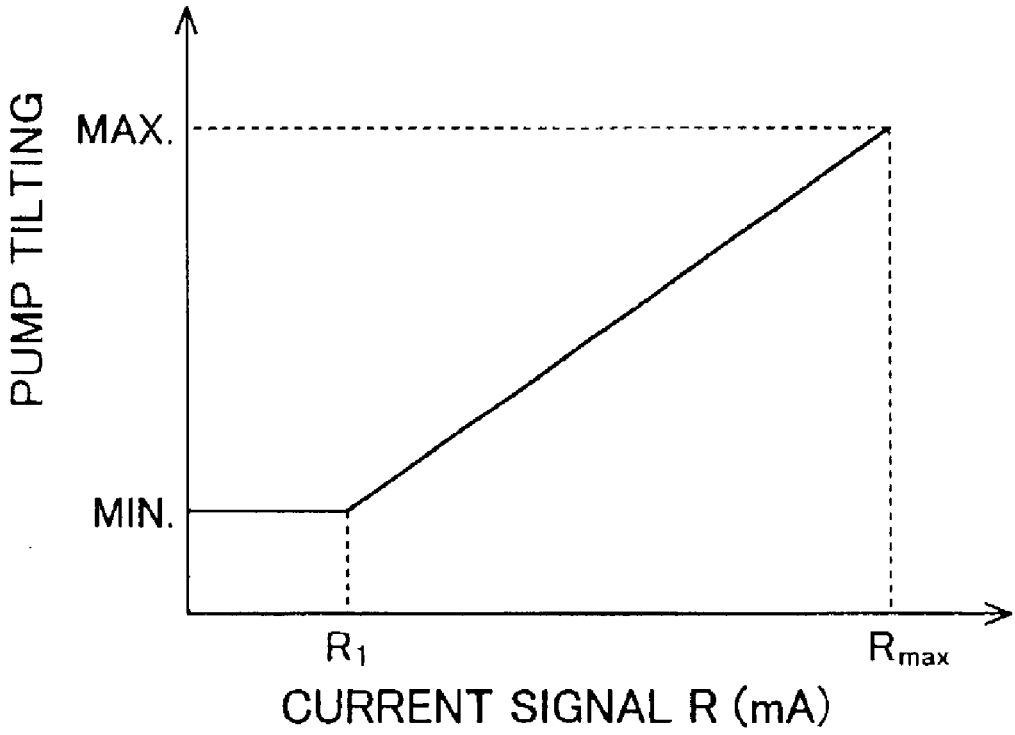
FIG. 5 is a graph showing the relationship between a control current signal applied to a solenoid proportional pressure-reducing valve in the regulator and a tilting angle of a hydraulic pump.

FIG. 5 shows the relationship between the control current signal R applied to the solenoid proportional pressure-reducing valve 60 and the tilting angle of the swash plate 2*a* of the hydraulic pump 2 (also referred to simply as the "tilting angle of the hydraulic pump 2" or the "pump tilting" hereinafter).

When the control current signal R is not larger than R1, the solenoid proportional pressure-reducing valve 60 is not operated and the control pressure produced by the solenoid proportional pressure-reducing valve 60 is zero (0). Hence, a spool 61*b* of the servo valve 61 is urged to the left in FIG. 4 by a spring 61*c*, whereupon the delivery pressure of the hydraulic pump 2 (or the delivery pressure of the pilot pump 66) acts upon a larger-diameter chamber 62*b* of the servo piston 62 through the check valve 63, a sleeve 61*d* and the spool 61*b*. Although the delivery pressure of the pump 2 also acts upon the smaller-diameter chamber 62*a* of the servo piston 62 through the passage 54, the servo piston 62 is moved to the right in FIG. 4 because of an area difference between the two chambers.

When the servo piston 62 is moved to the right in FIG. 4, a feedback lever 71 is rotated counterclockwise in FIG. 4 about a pin 72 serving as a fulcrum. Since a fore end of the feedback lever 71 is coupled to the sleeve 61*d* by a pin 73, the sleeve 61*d* is moved to the left in FIG. 4 with the counterclockwise rotation of the feedback lever 71. The movement of the servo piston 62 is continued until a gap at an opening of the spool 61*b* relative to the sleeve 61*d* is closed, and the servo piston 62 is stopped when the gap is completely closed.

Through the operation described above, the tilting angle of the hydraulic pump 2 is reduced to a minimum and the delivery rate of the hydraulic pump 2 is minimized.

When the control current signal R becomes larger than R1 and the solenoid proportional pressure-reducing valve 60 is operated, the control pressure is produced depending on an amount by which the solenoid proportional pressure-reducing valve 60 is shifted, and acts upon the pilot piston 61*a* of the servo valve 61 through the passage 67. Hence, the spool 61*b* is moved to the right in FIG. 4 to a position where the urging force is balanced by the force of the spring 61*c*. With such a movement of the spool 61*b*, the larger-diameter chamber 62*b* of the servo piston 62 is communicated with a reservoir 75 through a passage within the spool 61*b*. Because the delivery pressure of the hydraulic pump 2 (or the delivery pressure of the pilot pump 66) acts upon the small-diameter chamber 62*a* of the servo piston 62 through the passage 54 at all times, the servo piston 62 is moved to the left in FIG. 4 and the hydraulic fluid in the larger-diameter chamber 62*b* is returned to the reservoir 75.

When the servo piston 62 is moved to the left in FIG. 4, the feedback lever 71 is rotated clockwise in FIG. 4 about the pin 72 serving as a fulcrum and the sleeve 61*d* of the servo valve 61 is moved to the right in FIG. 4. The movement of the servo piston 62 is continued until a gap at an opening of the spool 61*b* relative to the sleeve 61*d* is closed, and the servo piston 62 is stopped when the gap is completely closed.

Through the operation described above, the tilting angle of the hydraulic pump 2 is increased and the delivery rate of the hydraulic pump 2 is also increased. The amount by which the delivery rate of the hydraulic pump 2 increases is proportional to the amount by which the control pressure rises, i.e., the amount by which the control current signal R increases.

When the control current signal R is reduced and the control pressure produced by the solenoid proportional pressure-reducing valve 60 lowers, the spool 61*b* of the servo valve 61 is returned to the left in FIG. 4 to a position where the urging force is balanced by the force of the spring 61*c*. Therefore, the delivery pressure of the hydraulic pump 2 (or the delivery pressure of the pilot pump 66) acts upon the larger-diameter chamber 62*b* of the servo piston 62 through the sleeve 61*d* and the spool 61*b* of the servo valve 61. As a result, the servo piston 62 is moved to the right in FIG. 4 because of an area difference between the larger-diameter chamber 62*b* and the smaller-diameter chamber 62*a*.

When the servo piston 62 is moved to the right in FIG. 4, the feedback lever 71 is rotated counterclockwise in FIG. 4 about the pin 72 serving as a fulcrum, and the sleeve 61*d* of the servo valve 61 is moved to the left in FIG. 4. The movement of the servo piston 62 is continued until the gap at the opening of the spool 61*b* relative to the sleeve 61*d* is closed, and the servo piston 62 is stopped when the gap is completely closed.

Through the operation described above, the tilting angle of the hydraulic pump 2 is reduced and the delivery rate of the hydraulic pump 2 is also reduced. The amount by which the delivery rate of the hydraulic pump 2 reduces is proportional to the amount by which the control pressure lowers, i.e., the amount by which the control current signal R reduces.

Figure 6:
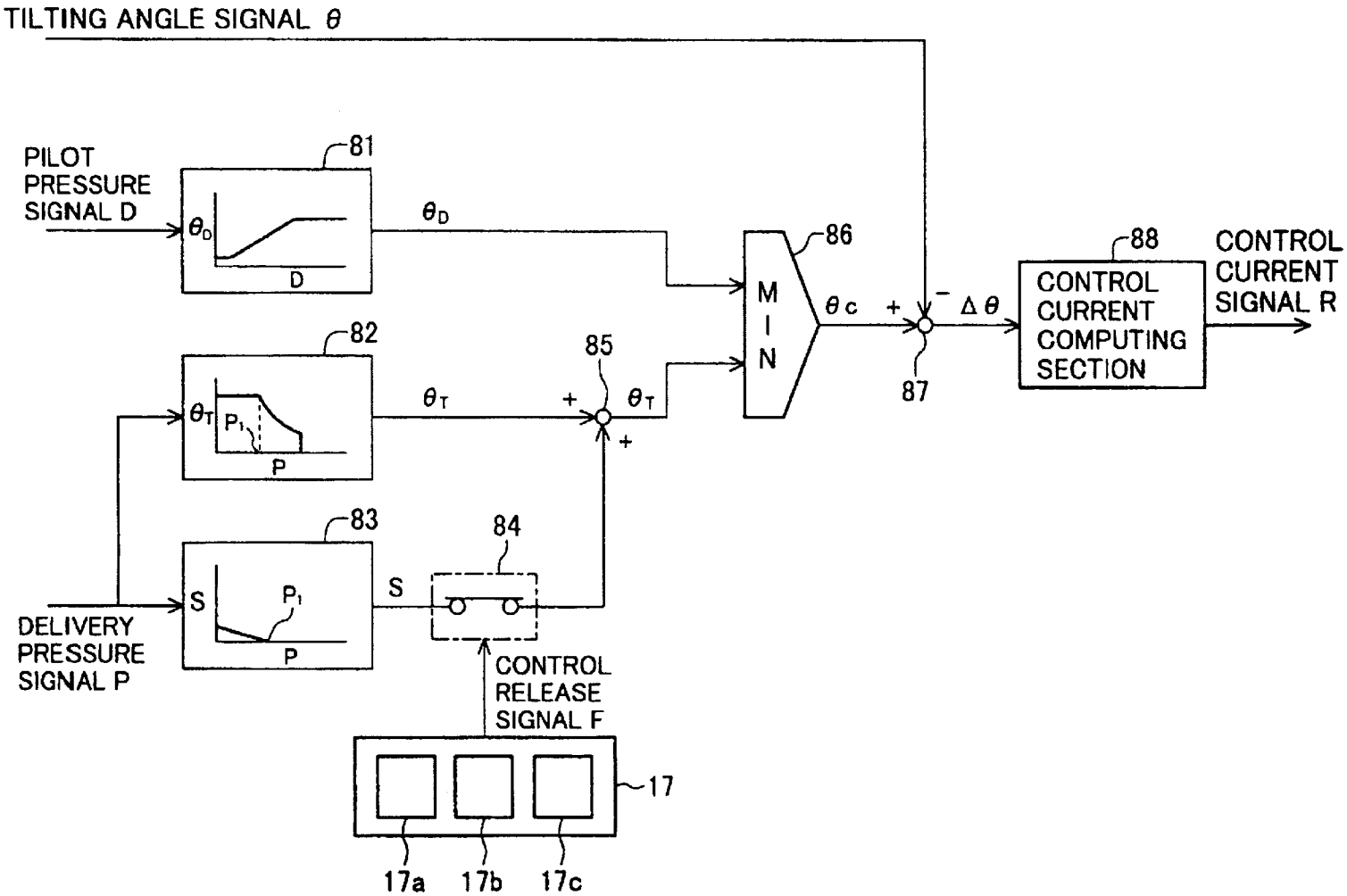
FIG. 6 is a functional block diagram showing processing functions of a working machine controller.

FIG. 6 is a functional block diagram showing details of the mode selection switch 17 and processing functions of the working machine controller 18.

The mode selection switch 17 includes, for example, a travel mode switch 17*a*, a load lifting mode switch 17*b*, and a ground leveling mode switch 17*c*. When an operator operates one of those switches 17*a* to 17*c*, the control release signal F is outputted.

The working machine controller 18 has various functions executed by a first target pump tilting-angle computing section 81, a second target pump tilting-angle computing section 82, a tilting-angle modification value computing section 83, a switching section 84, an adder 85, a minimum value selector 86, a subtracter 87, and a control current computing section 88.

The first target pump tilting-angle computing section 81 receives the pilot pressure signal D from the pressure sensor 55 and refers to a table stored in a memory using the received signal D, thereby computing a first target tilting θD of the hydraulic pump 2 corresponding to the pilot pressure indicated by the signal D at that time. The first target tilting θD is a target tilting for positive control depending on a lever shift amount (demanded flow rate) of each of the control lever devices 50, . . . (see FIG. 1). The relationship between the pilot pressure and the first target pump tilting θD is set in the memory table such that as the pilot pressure increases, the first target tilting θD is also increased.

The second target pump tilting-angle computing section 82 receives the delivery pressure signal P of the hydraulic pump 2 from the pressure sensor 14 and refers to a table stored in a memory using the received signal P, thereby computing a second target tilting θT of the hydraulic pump 2 corresponding to the pump delivery pressure (hereinafter denoted by the same symbol P as the signal for convenience of explanation) indicated by the signal P at that time. The second target tilting θT serves as a limit value for performing torque control of the hydraulic pump 2. The relationship between the pump delivery pressure P and the second target tilting θT (limit value) of the hydraulic pump 2 is set in the memory table based on a pump absorption torque curve, as shown in FIG. 7.

Figure 7:
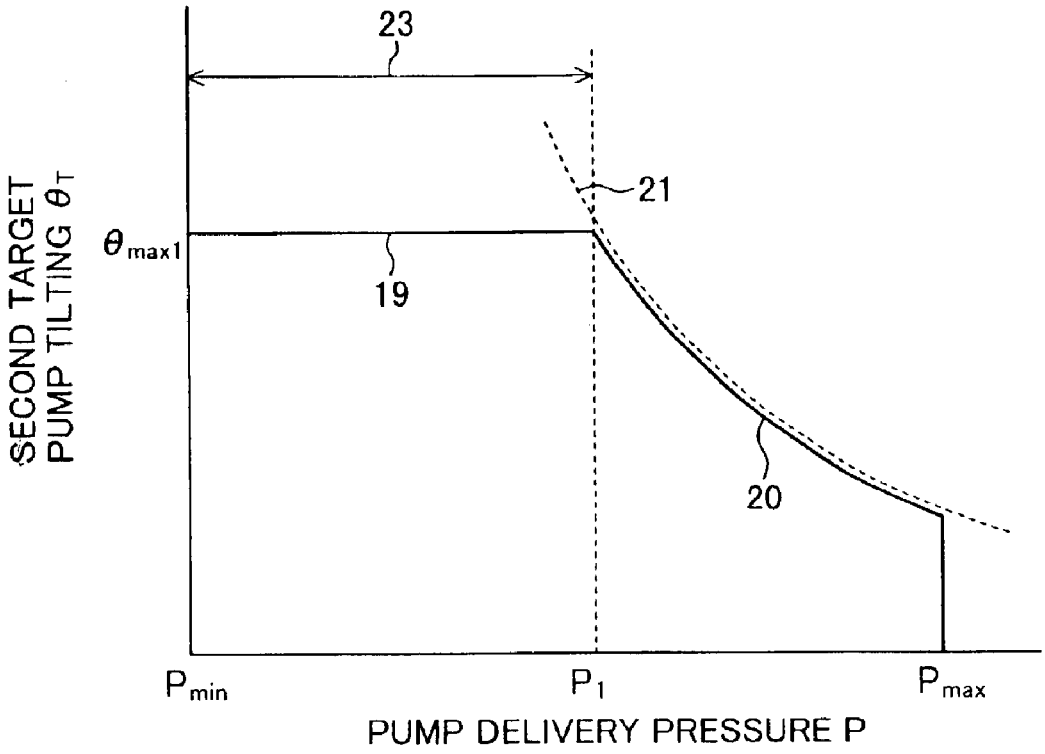
FIG. 7 is a graph showing the relationship between a pump delivery pressure and a second target tilting, which is used in a second target tilting-angle computing section of the working machine controller.

Referring to FIG. 7, numeral 20 represents the pump absorption torque curve that is set to be matched with a curve 21 of the output torque Te (see FIG. 3) at a predetermined revolution speed of the engine 1 (e.g., at a rated revolution speed NO). In the range where the pump delivery pressure P is not lower than P1, the second target pump tilting θT is changed along the pump absorption torque curve 20 such that the second target pump tilting θT is reduced as the pump delivery pressure P increases.

When the pump delivery pressure P is P1, the second target pump tilting •T takes a first maximum tilting •max1. In the range where the delivery pressure P not lower than P1, the second target pump tilting •T is held at the first maximum tilting •max1 as indicated by a characteristic line 19. The first maximum tilting •max1 is a value decided depending on design specifications of a hydraulic excavator, for example, design specifications such as the operating speeds of the swing motor 112, the boom cylinder 113, the arm cylinder 114, and the bucket cylinder 115 (i.e., the hydraulic cylinders 3, 5 and 6 and the hydraulic motor 4). In other words, the first maximum tilting •max1 is set such that the pump delivery rate obtained at the first maximum tilting •max1 provides desired speeds of the actuators.

Pmin represents a minimum delivery pressure of the hydraulic pump 2, and Pmax represents a maximum delivery pressure of the hydraulic pump 2. The maximum delivery pressure Pmax corresponds to a setting pressure of the main relief valve 11 (see FIG. 1).

Also, a range 23 between the minimum delivery pressure Pmin and the pressure P1 corresponds to the above-mentioned governor region 33.

The absorption torque of the hydraulic pump 2 is represented by the product of the delivery pressure of the hydraulic pump 2 and the displacement (tilting angle) of the hydraulic pump 2. Accordingly, the process of computing the second target pump tilting θT corresponding to the pump delivery pressure P from the pump absorption torque curve 20 and controlling the tilting angle of the hydraulic pump 2 to be equal to the second target pump tilting θT means control of the tilting of the hydraulic pump 2 in which the product of the pump delivery pressure P and the second target pump tilting θT (i.e., the absorption torque of the hydraulic pump 2) is held at the pump absorption torque (constant value) represented by the curve 20.

Figure 8:
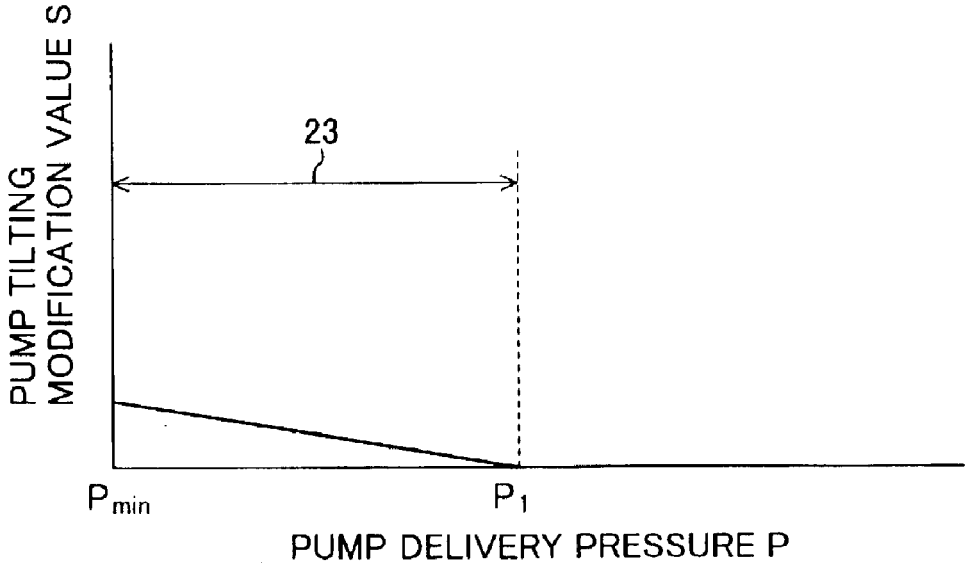
FIG. 8 is a graph showing the relationship between a pump delivery pressure and a pump tilting-angle modification value, which is used in a tilting-angle modification value computing section of the working machine controller.

The tilting-angle modification value computing section 83 receives the delivery pressure signal P of the hydraulic pump 2 from the pressure sensor 14 and refers to a table stored in a memory using the received signal P, thereby computing a modification value S of the second target tilting θT of the hydraulic pump 2 corresponding to the pump delivery pressure (hereinafter also denoted by the same symbol P as the signal) indicated by the signal P at that time. The modification value S serves to modify the tilting angle of the hydraulic pump 2 such that, in spite of the engine revolution speed being held constant in the governor region 33 (FIG. 3) with the isochronous control, the tilting angle of the hydraulic pump 2 is increased to increase the delivery rate as the engine load reduces. The relationship between the delivery pressure P and the modification value S is set in the memory table such that, as shown in FIG. 8, when the pump delivery pressure P is not lower than P1, the modification value S=0 is set, and when the delivery pressure P is lower than P1, the modification value S is linearly proportionally increased as the delivery pressure P lowers.

The switching section 84 is turned off with the control release signal F being outputted from the mode selection switch 17, whereby the modification value S of the target pump tilting is made ineffective.

The adder 85 adds the modification value S of the target pump tilting computed by the tilting-angle modification value computing section 83 to the second target tilting θT of the hydraulic pump 2 computed by the second target pump tilting-angle computing section 82, thereby computing the modified second target tilting θT.

Figure 9:
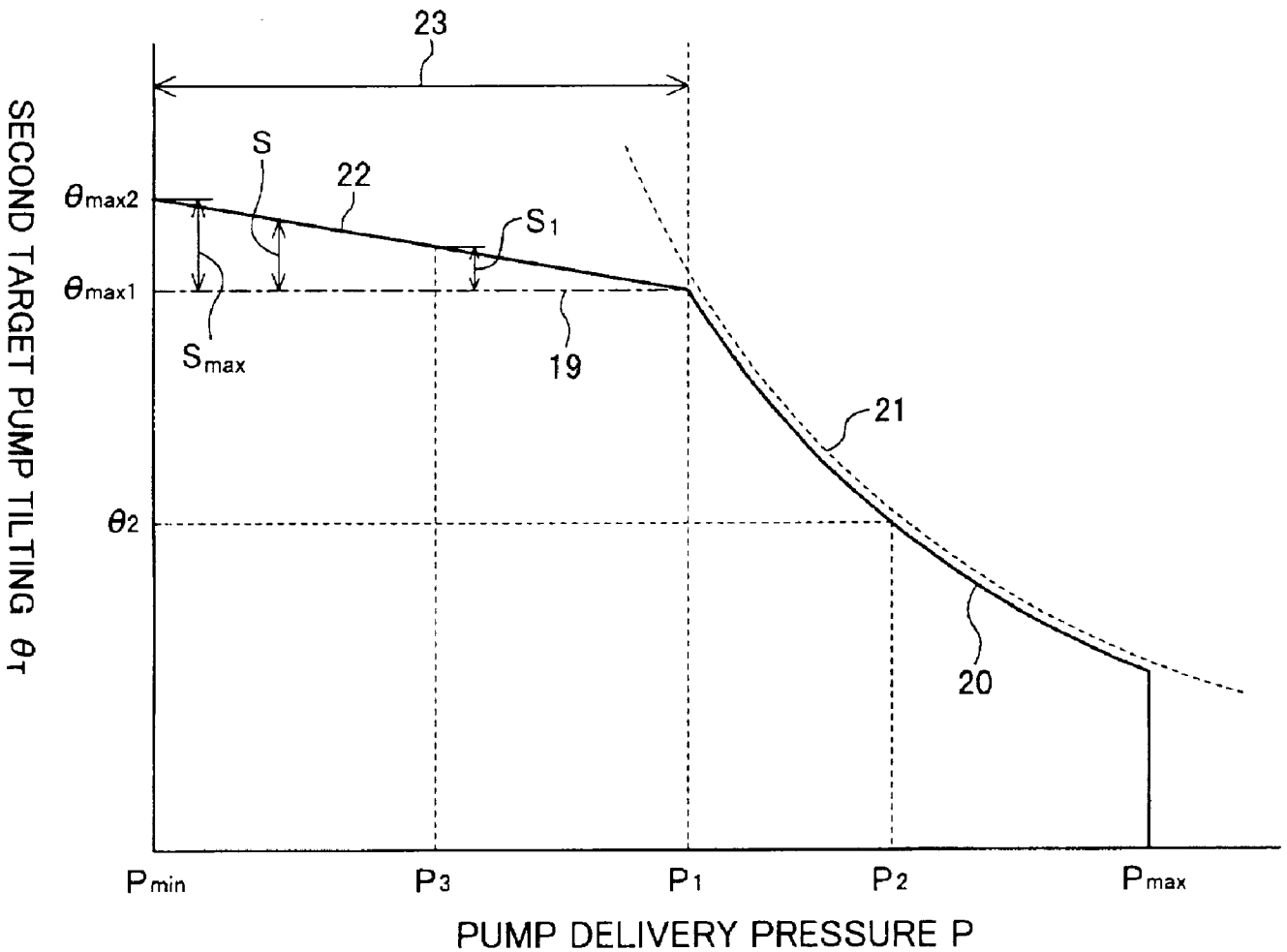
FIG. 9 is a graph showing the relationship between a pump delivery pressure and a second target pump tilting, which has been modified by an adder.

FIG. 9 shows the relationship between the delivery pressure P and the second target tilting θT, which has been modified by the adder 85.

By adding the modification value S to the second target tilting θT, the characteristic line 19 shown in FIG. 7 is modified to a characteristic line 22. Thus, as the pump delivery pressure P lowers from P1 to Pmin, the modified second target tilting θT is linearly increased from the first maximum tilting θmax1 to a second maximum tilting θmax2 (=first maximum tilting θmax1+Smax). The second maximum tilting θmax2 is set corresponding to, for example, a structural maximum tilting (pump capability limit) of the hydraulic pump 2.

The minimum value selector 86 selects a smaller one between the first target tilting θD of the hydraulic pump 2 computed by the first target pump tilting-angle computing section 81 and the second target tilting θT modified by the adder 85, and sets the selected one as a target tilting θc for control of the hydraulic pump 2. Accordingly, when the first target tilting θD of the hydraulic pump 2 computed by the first target pump tilting-angle computing section 81 is larger than the modified second target tilting θT, the modified second target tilting θT is outputted as the target pump tilting θc for control, whereby the target pump tilting θc for control is limited to be not larger than the modified second target tilting θT.

The subtracter 87 computes a deviation Δθ between the target pump tilting θc for control and the tilting angle signal θ outputted from the tilting angle sensor 15. The control current computing section 88 computes the control current signal R from the deviation Δθ through, e.g., integral control computation. As a result, the tilting angle signal θ is controlled to be matched with the target pump tilting θc for control.

This embodiment having the above-described construction operates as follows.

A description is first made of the case in which any of the switches 17*a* to 17*c* of the mode selection switch 17 is not operated and the control release signal F is not outputted, i.e., the case in which the switching section 84 of the working machine controller 18 is turned on.

When the engine 1 is started up to drive the hydraulic pump 2 and one of the control lever devices 50, . . . is operated, the hydraulic fluid delivered from the hydraulic pump 2 is supplied to the hydraulic cylinder 3, 5, 6 or the hydraulic motor 4, etc. through a corresponding one of the directional control valves 7 to 10. The front working device 104, for example, of the hydraulic excavator, shown in FIG. 2, is thereby driven to perform, e.g., the work for excavating earth and sand.

In the working machine controller 18, the first target pump tilting-angle computing section 81 computes the first target tilting θD of the hydraulic pump 2 corresponding to the pilot pressure signal D outputted from the pressure sensor 55, the second target pump tilting-angle computing section 82 computes the second target tilting θT of the hydraulic pump 2 corresponding to the delivery pressure signal P of the hydraulic pump 2 outputted from the pressure sensor 14, and the tilting-angle modification value computing section 83 computes the modification value S of the target tilting of the hydraulic pump 2 corresponding to the delivery pressure signal P of the hydraulic pump 2 outputted from the pressure sensor 14.

On that occasion, when the lever shift amount of the control lever device is small and θD<θc (=θT) is satisfied, the minimum value selector 86 selects, as the target tilting θc for control, the first target tilting θD of the hydraulic pump 2 computed by the first target pump tilting-angle computing section 81. The subtracter 87 and the control current computing section 88 compute the control current signal R for making the tilting angle signal θ matched with the target tilting θc, and the control current signal R is outputted to the solenoid proportional pressure-reducing valve 60 of the regulator 16. As a result, the tilting angle of the hydraulic pump 2 is controlled to be matched with the target tilting θc (=θD) for control and the hydraulic pump 2 delivers the hydraulic fluid at a flow rate proportional to the product of the target tilting θc and the revolution speed N of the engine 1 at that time. This delivery rate is given depending on the lever shift amount of the control lever device and is supplied to a corresponding one of the hydraulic cylinders 3, 5 and 6 and the hydraulic motor 4, whereby the corresponding actuator is driven at the speed depending on the shift amount of the control lever device.

On the other hand, for example, when the control lever of the control lever device is fully operated and θD>θc (=θT) is satisfied, the minimum value selector 86 selects, as the target tilting θc for control, the second target tilting θT of the hydraulic pump 2 computed by the second target pump tilting-angle computing section 82. Then, the control current signal R computed from both the target tilting θc and the tilting angle signal θ is outputted to the solenoid proportional pressure-reducing valve 60 of the regulator 16.

Assuming now, for example, that heavy excavation or the like is performed and the pump delivery pressure indicated by the signal P outputted from the pressure sensor 14 takes P2 higher than P1 shown in FIG. 9, the tilting-angle modification value computing section 83 computes the modification value S=0 and the second target pump tilting-angle computing section 82 computes the second target tilting θT=θ2. This computed θ2 is used, as it is, as the second target tilting θT. Therefore, the tilting angle of the hydraulic pump 2 is limited to θ2 and the delivery rate of the hydraulic pump 2 is also limited to a flow rate Q1 given below:

$$Q1=a\cdot\theta 2\cdot N \text{ (}a\text{ is a constant)}$$

Since the delivery rate of the hydraulic pump 2 is thus limited, the horsepower consumed by the hydraulic pump 2 represented by the product of the delivery rate and the delivery pressure of the hydraulic pump 2 is also limited. Consequently, the engine 1 can be prevented from undergoing overload, and effective use of output horsepower of the engine 1 can be achieved within a range in which an engine stall does not occur.

The above control of the tilting angle of the hydraulic pump 2 in accordance with the pump absorption torque curve 20 is called pump absorption torque control, and the above control of the delivery rate of the hydraulic pump 2 is called pump absorption horsepower control.

When the earth and sand, for example, is discharged from the bucket 110 in the above-described condition and the front working device is operated under no load, the delivery pressure P of the hydraulic pump 2 is reduced from P2. Then, when the pump delivery pressure P is reduced to, e.g., P3 lower than P1, the tilting-angle modification value computing section 83 computes the modification value S=S1 and the second target pump tilting-angle computing section 82 computes the second target tilting θT=θmax1, whereby a value resulting from adding the modification value S1 to θmax1 is provided as the second target tilting θT. Hence, the tilting angle of the hydraulic pump 2 is controlled to be θmax1+S1 and the delivery rate of the hydraulic pump 2 is controlled to be a flow rate Q3 given below:

$$Q3=a\cdot(\theta\max 1+S1)\cdot N$$

Stated otherwise, the tilting angle of the hydraulic pump 2 is increased by an amount corresponding to the modification value S1 in comparison with the first maximum tilting θmax1 that is the tilting angle resulting when the delivery pressure of the hydraulic pump 2 is at P1. The delivery rate of the hydraulic pump 2 is also increased correspondingly.

Herein, the modification value S is set such that it is linearly proportionally increased as the pump delivery pressure P lowers from P1. More specifically, as represented by the characteristic line 22, the modified second target tilting θT is linearly proportionally increased from the first maximum tilting θmax1 to the second maximum tilting θmax2 (=θmax1+Smax) as the delivery pressure P lowers from P1. In spite of the revolution speed of the engine 1 being held constant in the range 23 corresponding to the governor region 33 (FIG. 3) with the isochronous control, therefore, the delivery rate of the hydraulic pump 2 is controlled to gradually increase as the engine load reduces. Correspondingly, the operating speeds of the hydraulic actuators, such as the hydraulic cylinders 3, 5 and 6 and the hydraulic motor 4, can be increased. The characteristic represented by the characteristic line 22 is apparently almost matched with the drooping characteristic line 31 in the mechanical governor shown in FIG. 3.

Figure 10A:
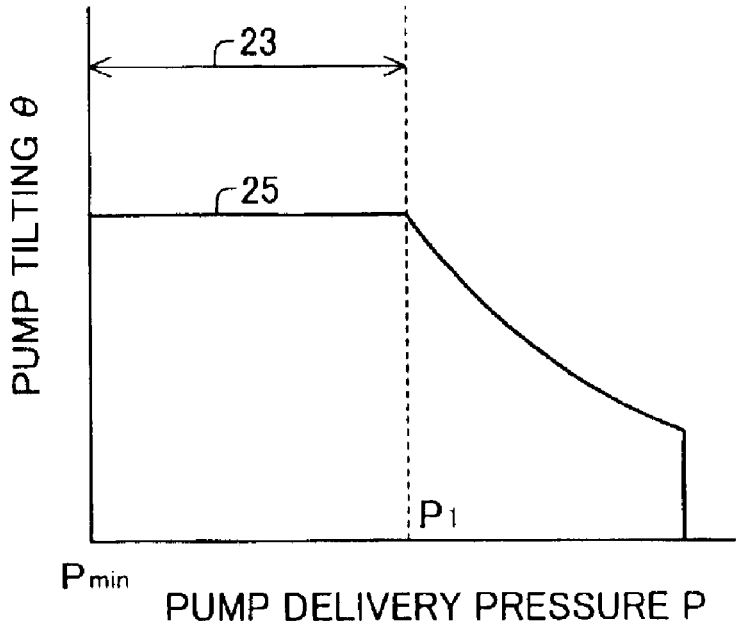
FIG. 10A is a graph showing the relationship between a pump delivery pressure P and a pump tilting θ in a prior-art system including a mechanical governor-equipped engine controlled in a governor region based on a drooping characteristic.
Figure 10B:
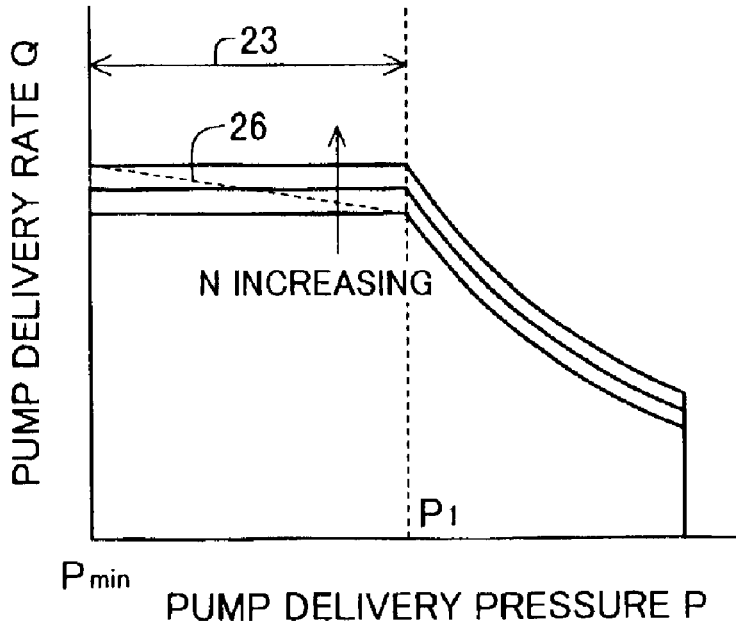
FIG. 10B is a graph showing the relationship between a pump delivery pressure and a pump delivery rate in the prior-art system.

FIGS. 10A and 10B show, respectively, the relationship between a pump delivery pressure P and a pump tilting e and the relationship between a pump delivery pressure and a pump delivery rate in a prior-art system including a mechanical governor-equipped engine controlled in a governor region based on a drooping characteristic.

In the prior-art system which does not include the tilting-angle modification value computing section 83, the switching section 84, and the adder 85, shown in FIG. 6, as the processing functions of a working machine controller, the pump tilting θ is constant as represented by a straight line 25 in the range 23 between Pmin and P1 corresponding to the governor region 33 (FIG. 3). On the other hand, as represented by the broken line 31 in FIG. 3, the mechanical governor-equipped engine provides, in the governor region 33, a drooping characteristic that the engine revolution speed N is increased as the engine output torque (engine load) Te reduces. In the range 23 between Pmin and P1, therefore, the engine revolution speed N is increased as the pump delivery pressure P lowers from P1. Hence, in spite of the pump tilting θ being constant, the pump delivery rate Q is increased with an increase of the engine revolution speed N, as represented by a broken line 26. Consequently, the flow rate of the hydraulic fluid supplied to the hydraulic actuator is increased, whereby the working speed in the no-load operation can be increased and the working efficiency can be improved.

Figure 11A:
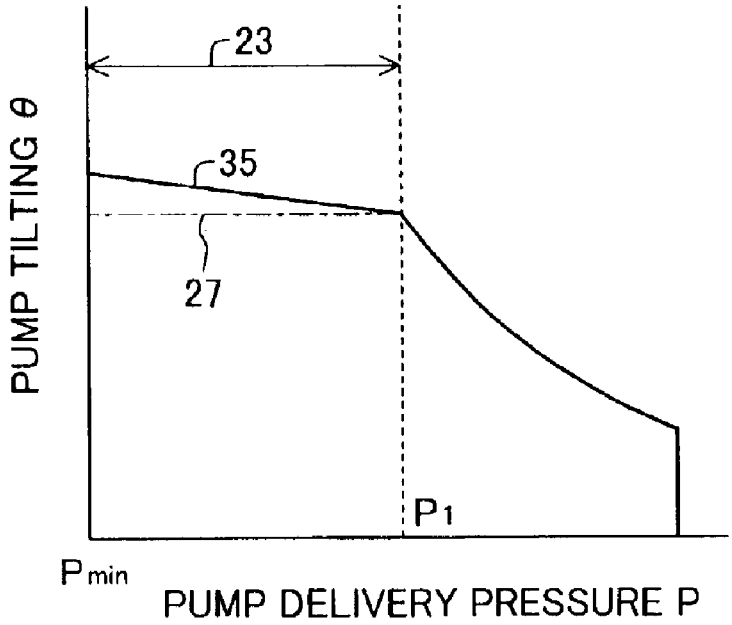
FIG. 11A is a graph showing the relationship between a pump delivery pressure P and a pump tilting θ in a prior-art system and the first embodiment including an engine controlled in a governor region based on an isochronous characteristic.
Figure 11B:
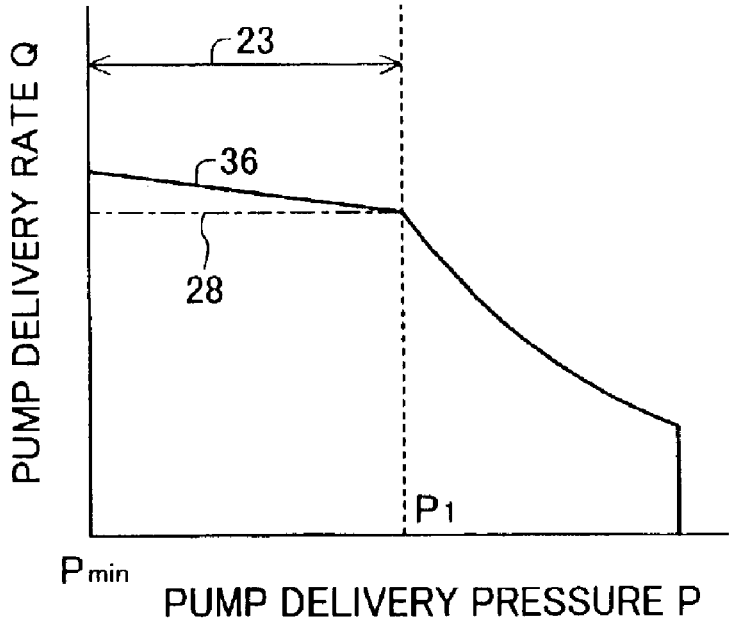
FIG. 11B is a graph showing the relationship between a pump delivery pressure and a pump delivery rate in the prior-art system and the first embodiment.

FIGS. 11A and 11B show, respectively, the relationship between a pump delivery pressure P and a pump tilting θ and the relationship between a pump delivery pressure and a pump delivery rate in a prior-art system including an engine controlled in a governor region based on an isochrounous characteristic and in this embodiment.

In the governor region 33 of the engine controlled in the governor region based on the isochrounous characteristic, as represented by the straight line 32 in FIG. 3, the engine revolution speed N is held constant at the rated speed N0 regardless of reduction of the engine output torque Te. In the range 23 between Pmin and P1 corresponding to the governor region 33, therefore, when the pump tilting θ is constant as represented by a one-dot-chain line 27, the pump delivery rate Q is also constant as represented by a one-dot-chain line 28 in FIG. 11B. In contrast, according to this embodiment, in the range 23 between Pmin and Pi corresponding to the governor region 33, the pump tilting θ is changed as represented by a straight line 35 corresponding to the characteristic line 22 in FIG. 9 and the pump delivery rate Q is increased with an increase of the pump tilting θ as represented by a straight line 36. Thus, in spite of the engine revolution speed N being constant, the pump delivery rate Q is linearly proportionally increased as the pump delivery pressure P lowers from P1. As a result, similarly to the prior-art system shown in FIGS. 10A and 10B, the flow rate of the hydraulic fluid supplied to the hydraulic actuator is increased, whereby the working speed in the no-load operation can be increased and the working efficiency can be improved.

Additionally, in some kinds of operation or work, such as traveling, load lifting and ground leveling, it is not desired to increase, as described above, the delivery rate of the hydraulic pump 2 when the engine load is small. In the case of performing that kind of operation or work, the operator operates a corresponding one of the switches 17*a* to 17*c* of the mode selection switch 17. Upon the switch operation, the control release signal F is outputted from the mode selection switch 17 to the working machine controller 18, whereby the switching section 84 is turned off and the modification value S of the target pump tilting is made ineffective. Consequently, the tilting-angle modification value computing section 83 does not perform the control for increasing the delivery rate of the hydraulic pump 2 with the aid of the modification value S.

Note that the travel mode switch 17*a*, for example, of the mode selection switch 17 may be operated when a signal from a detecting means for detecting the operation of the travel control lever is inputted to the working machine controller 18. This is similarly applied to the other mode switches 17*b*, 17*c*.

With this embodiment having the construction described above, in the system including the engine 1 employing the isochronous control, the pump delivery rate Q can be gradually increased even in the governor region 33 as the engine load reduces. In other words, an increase of the pump delivery rate can be achieved substantially comparably to an increase of the flow rate in the mechanical governor based on the drooping characteristic. Hence, the hydraulic actuator speed at a small engine load can be increased and the working efficiency at a small load, e.g., in no-load work, can be improved. Further, even an operator, who has been well experienced in operation of the working machine including the mechanical governor-equipped engine, can be given with a good operation feeling.

Moreover, in the case of performing the traveling operation, the load lifting work and the ground leveling work, the modification value S computed by the tilting-angle modification value computing section 83 is made ineffective and the isochronous control is carried out based on the isochronous characteristic line 32 shown in FIG. 3. Accordingly, the delivery rate of the hydraulic pump 2 is held constant regardless of the engine load, and the hydraulic actuator can be operated at a constant speed in spite of an increase or decrease of the engine load. As a result, the traveling operation, the load lifting work and the ground leveling work can be satisfactorily performed.

A second embodiment of the present invention will be described with reference to FIGS. 12 to 17B. In this embodiment, the present invention is applied to a hydraulic drive system including an engine equipped with a fuel injection control unit capable of performing control in a governor region based on a reverse drooping characteristic.

An overall construction of the hydraulic drive system according to this embodiment is essentially the same as that of the first embodiment, shown in FIG. 1, except for the following point.

In this embodiment, the fuel injection control unit comprising the electronic governor 12 and the engine controller 13, shown in FIG. 1, can perform control in the governor region based on a reverse drooping characteristic. Thus, the engine 1 is controlled in the governor region such that the revolution speed of the engine 1 is reduced as the engine output torque Te (engine load) reduces.

Figure 12:
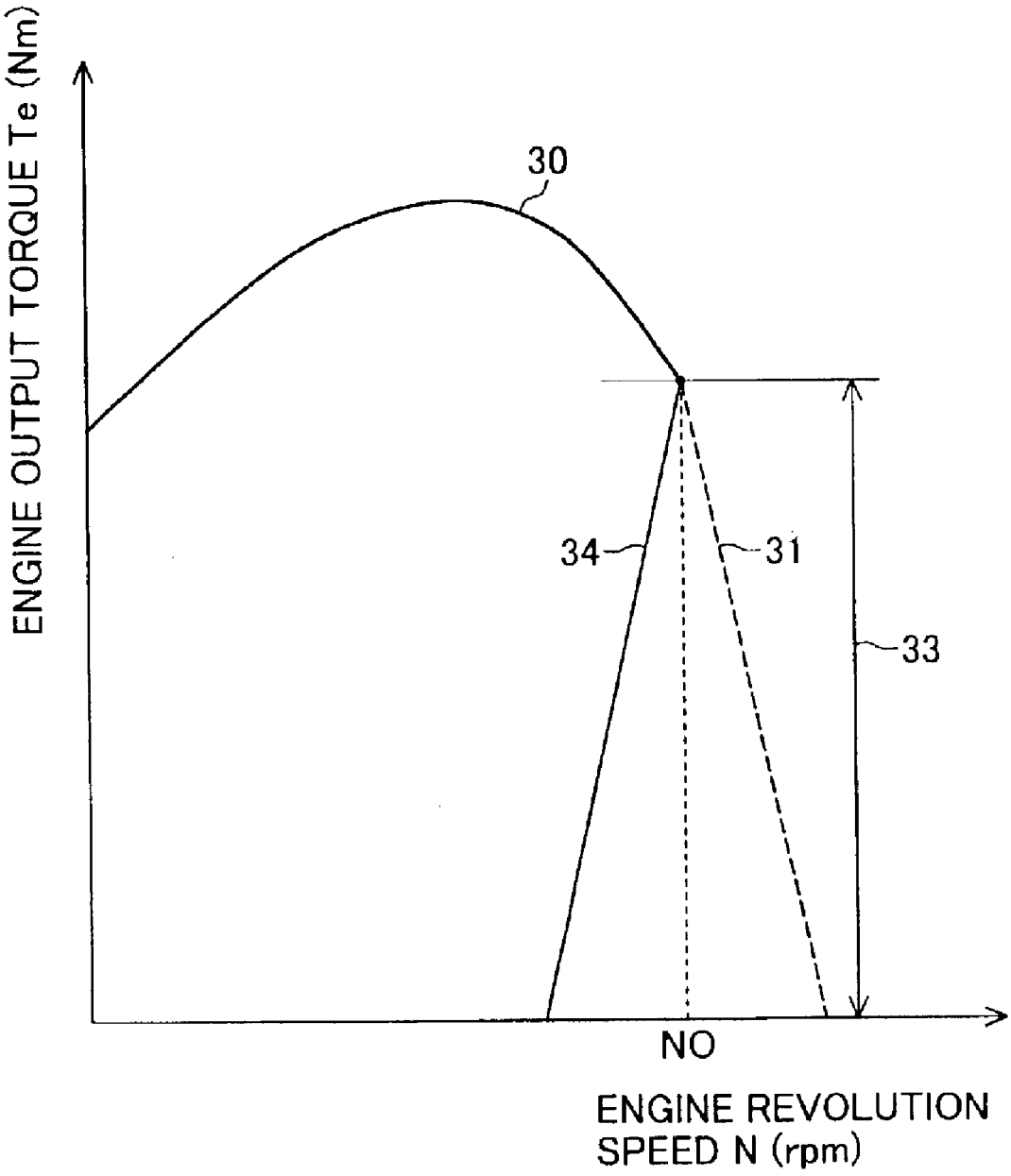
FIG. 12 is a characteristic graph showing the relationship between a revolution speed and an output torque of an engine equipped with an electronic governor performing control based on a reverse drooping characteristic according to a second embodiment of the present invention.

FIG. 12 shows the relationship between a revolution speed N and an output torque Te of the engine 1 controlled based on a reverse drooping characteristic. Referring to FIG. 12, as represented by a straight line 34, the governor region has a reverse drooping characteristic that the engine revolution speed N is reduced as the engine output torque Te (engine load) reduces. According to the reverse drooping characteristic, in comparison with the drooping characteristic and the isochronous characteristic, the engine revolution speed at a small load is further reduced, whereby lower fuel consumption and less noise can be realized.

Figure 13:
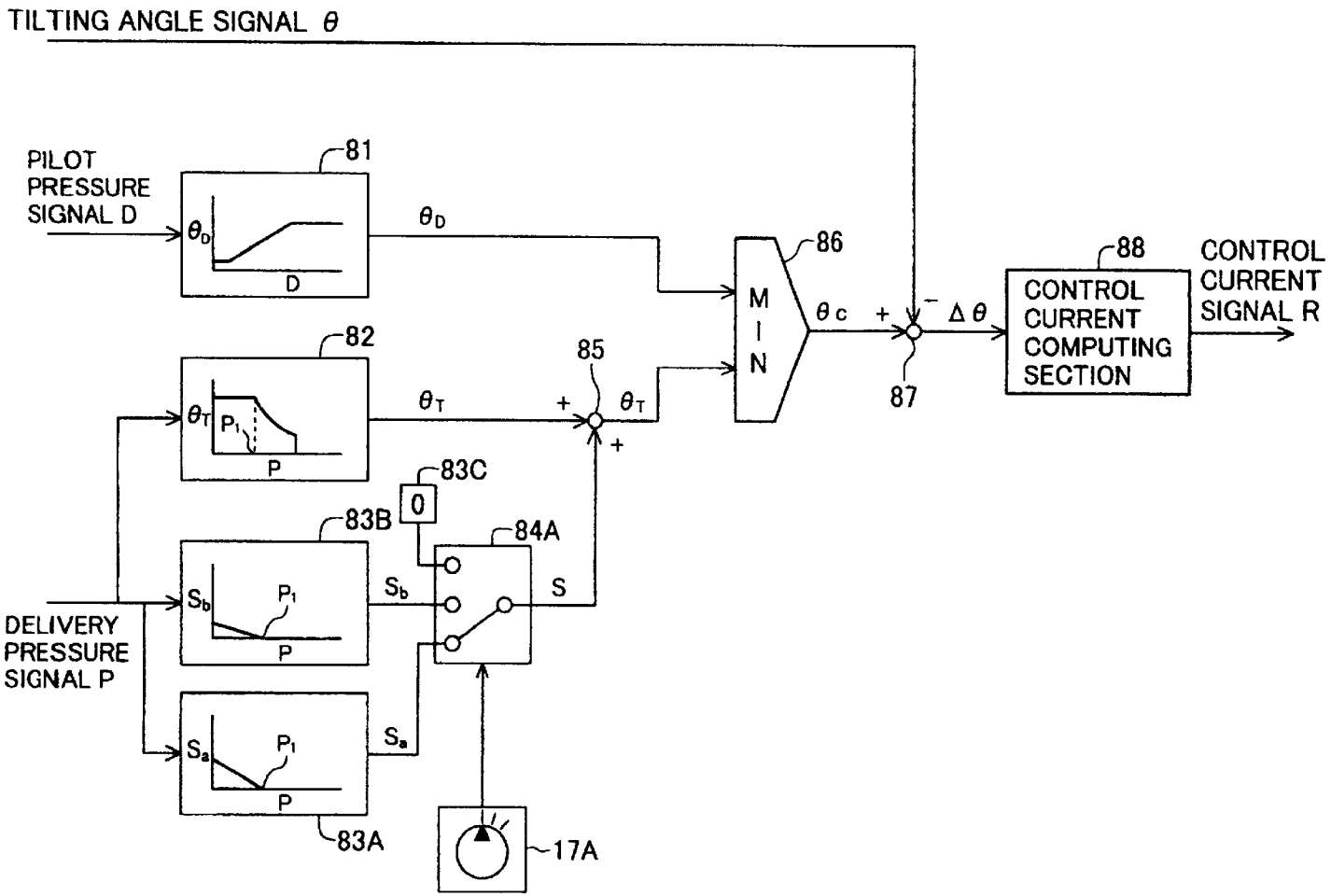
FIG. 13 is a functional block diagram showing processing functions of a working machine controller according to the second embodiment of the present invention.

FIG. 13 is a functional block diagram showing processing functions of a working machine controller 18 according to this embodiment.

The working machine controller 18 has various functions executed by a first target pump tilting-angle computing section 81, a second target pump tilting-angle computing section 82, a first tilting-angle modification value computing section 83A, a second tilting-angle modification value computing section 83B, a 0-setting section 83C, a switching section 84A, an adder 85, a minimum value selector 86, a subtracter 87, and a control current computing section 88.

Each of the first and second tilting-angle modification value computing sections 83A, 83B receives the delivery pressure signal P of the hydraulic pump 2 from the pressure sensor 14 and refers to a table stored in a memory using the received signal P, thereby computing a modification value S of the second target tilting θT of the hydraulic pump 2.

Figure 14:
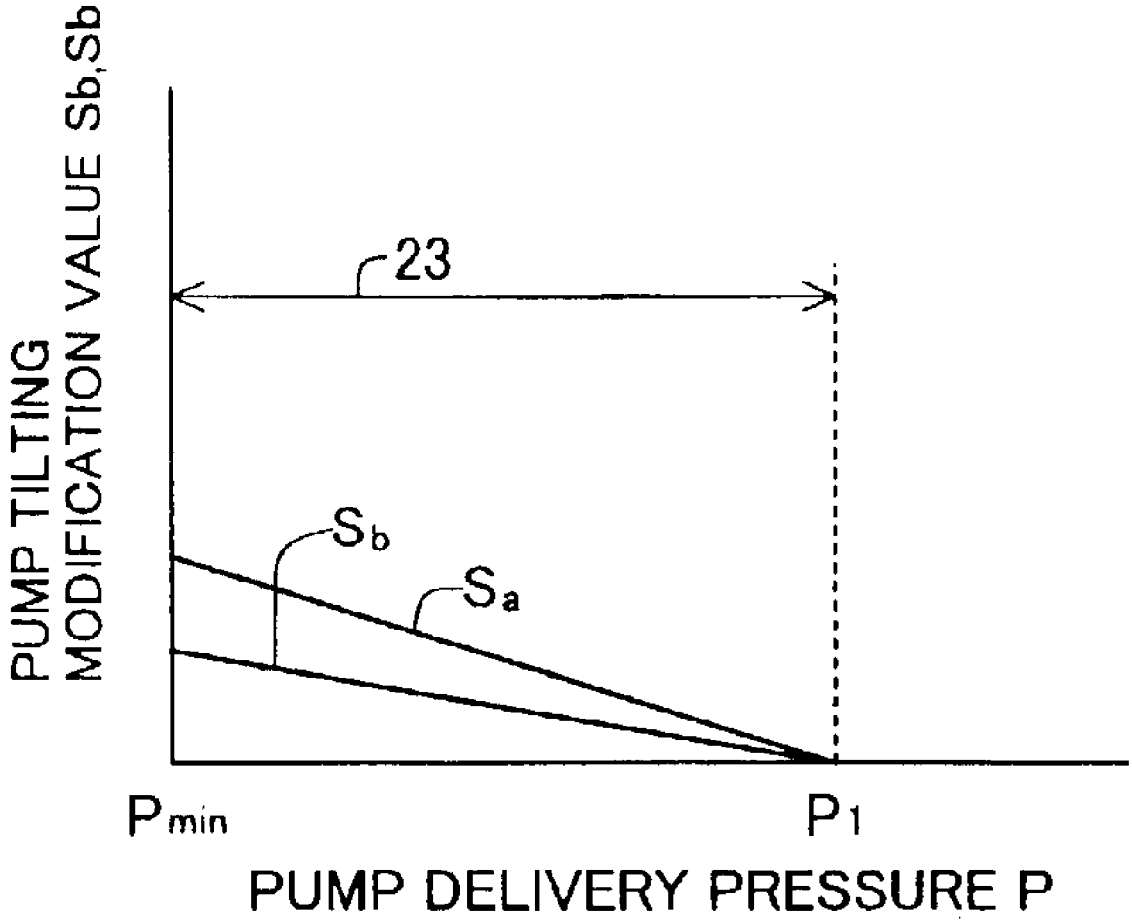
FIG. 14 is a graph showing the relationship between a pump delivery pressure and a pump tilting-angle modification value, which is used in a tilting-angle modification value computing section of the working machine controller.

The first tilting-angle modification value computing section 83A serves to modify the tilting angle of the hydraulic pump 2 such that, in spite of the engine revolution speed being reduced in the governor region 33 based on the reverse drooping characteristic, the delivery rate of the hydraulic pump 2 is increased as the engine load reduces. The relationship between the delivery pressure P and a modification value Sa is set in the memory table such that, as shown in FIG. 14, when the pump delivery pressure P is not lower than P1, the modification value Sa=0 is set, and when the delivery pressure P is lower than P1, the modification value Sa is linearly proportionally increased as the delivery pressure P lowers.

The second tilting-angle modification value computing section 83B serves to modify the tilting angle of the hydraulic pump 2 such that, in spite of the engine revolution speed being reduced in the governor region 33 due to the reverse drooping characteristic, the delivery rate of the hydraulic pump 2 is held constant regardless of the engine load. The relationship between the delivery pressure P and a modification value Sb is set in the memory table such that, as shown in FIG. 14, when the pump delivery pressure P is not lower than P1, the modification value Sb=0 is set, and when the delivery pressure P is lower than P1, the modification value Sb is linearly proportionally increased at a smaller rate than the modification value Sa computed by the first tilting-angle modification value computing section 83A as the delivery pressure P lowers.

The 0-setting section 83C outputs 0 as the modification value S.

The mode selection switch 17A is of the dial type having three first, second and third shift positions.

The switching section 84A selects the modification value Sa computed by the first tilting-angle modification value computing section 83A when the mode selection switch 17A is at a first position, as shown, the modification value Sb computed by the second tilting-angle modification value computing section 83B when the mode selection switch 17A is shifted to a second position,t and the modification value S (=0) outputted from by the 0-setting section 83C when the mode selection switch 17A is shifted to a third position.

The adder 85 adds, as with the first embodiment, the modification value S selected by the switching section 84A to the second target tilting θT of the hydraulic pump 2 computed by the second target pump tilting-angle computing section 82, thereby computing the modified second target tilting θT.

Figure 15:
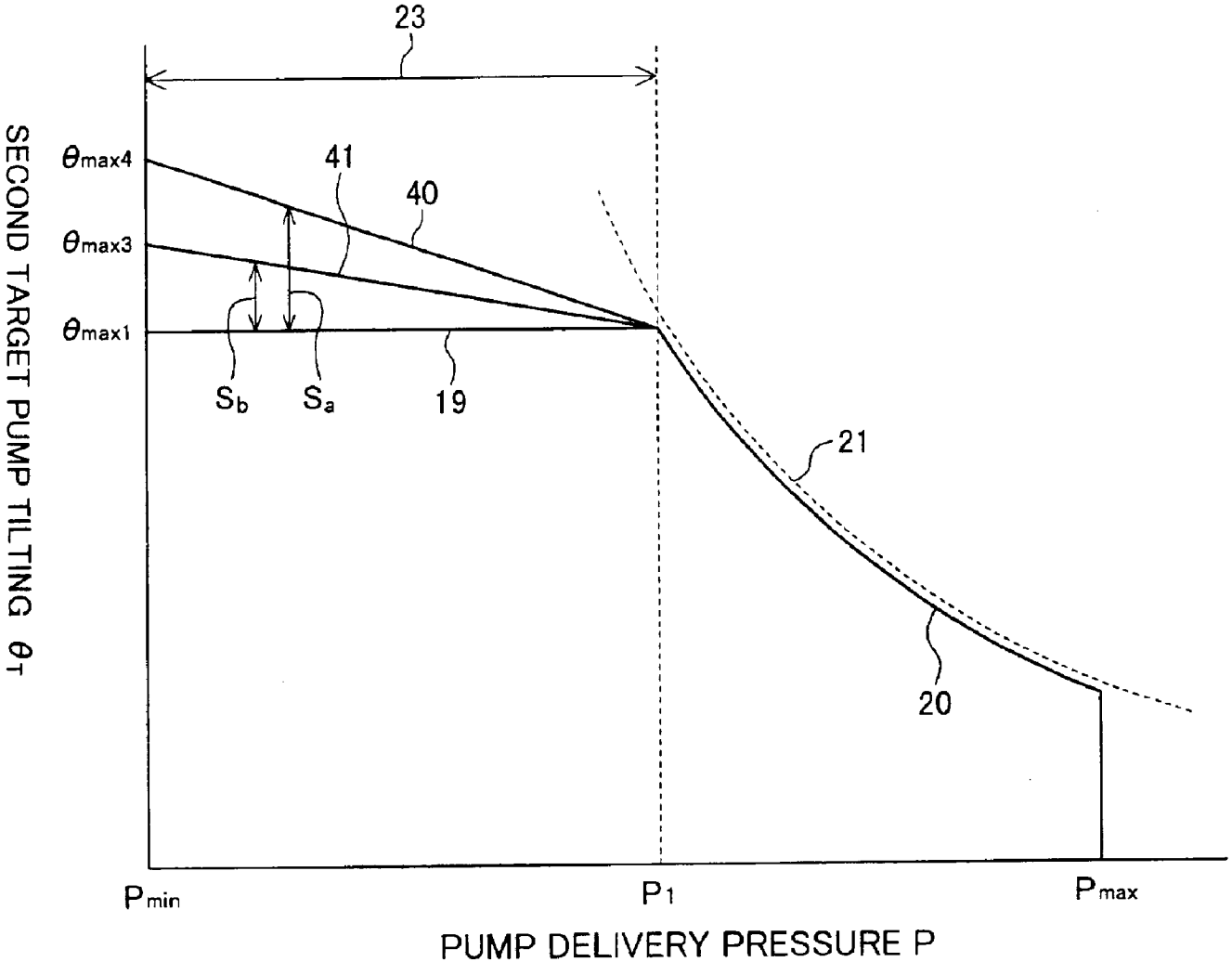
FIG. 15 is a graph showing the relationship between a delivery pressure signal and a second target tilting, which has been modified by an adder.

FIG. 15 shows the relationship between the pump delivery pressure P and the second target tilting θT, which has been modified by the adder 85.

When the switching section 84A selects the modification value Sa computed by the first tilting-angle modification value computing section 83A, the characteristic line 19 in the range 23 corresponding to the governor region 33 is modified to a characteristic line 40. Thus, as the pump delivery pressure P lowers from P1 to Pmin, the modified second target tilting •T is linearly increased from the first maximum tilting •max1 to a fourth maximum tilting •max4 (=first maximum tilting •max1+Samax). The fourth maximum tilting •max4 is set corresponding to, for example, a structural maximum tilting (pump capability limit) of the hydraulic pump 2.

When the switching section 84A selects the modification value Sb computed by the second tilting-angle modification value computing section 83B, the characteristic line 19 in the range 34 corresponding to the governor region 33 is modified to a characteristic line 41. Thus, as the pump delivery pressure P lowers from P1 to Pmin, the modified second target tilting •T is linearly increased from the first maximum tilting •max1 to a third maximum tilting •max3 (=first maximum tilting •max1+Sbmax).

When the switching section 84A selects the modification value S=0 outputted from the 0-setting section 83C, the characteristic line 19 in the range 23 corresponding to the governor region 33 is not modified, and the second target tilting •T computed by the second target pump tilting-angle computing section 82 is outputted as it is.

A characteristic represented by the characteristic line 40 is apparently almost matched with that represented by the drooping characteristic line 31 in the mechanical governor shown in FIG. 12, and a characteristic represented by the characteristic line 41 is apparently almost matched with that represented by the characteristic line 32 with the isochronous control shown in FIG. 3.

The operation of this embodiment having the above-described construction is essentially the same as that of the first embodiment except for that the engine 1 is controlled based on the reverse drooping characteristic and the control for increasing the delivery rate of the hydraulic pump 2 is performed based on the modification value Sa or Sb.

More specifically, assuming, for example, that the control lever of the control lever device is fully operated in work such as heavy excavation and •D>•c (=•T) and P>P1 are satisfied, when the mode selection switch 17A is shifted to the first position and the modification value Sa computed by the first tilting-angle modification value computing section 83A is selected, the control for increasing the tilting angle of the hydraulic pump 2 in accordance with the characteristic line 40 shown in FIG. 15 (i.e., the control for increasing the delivery rate) is performed. When the mode selection switch 17A is shifted to the second position and the modification value Sb computed by the second tilting-angle modification value computing section 83B is selected, the control for increasing the tilting angle of the hydraulic pump 2 in accordance with the characteristic line 41 shown in FIG. 15 (i.e., the control for holding the delivery rate) is performed.

Figure 16A:
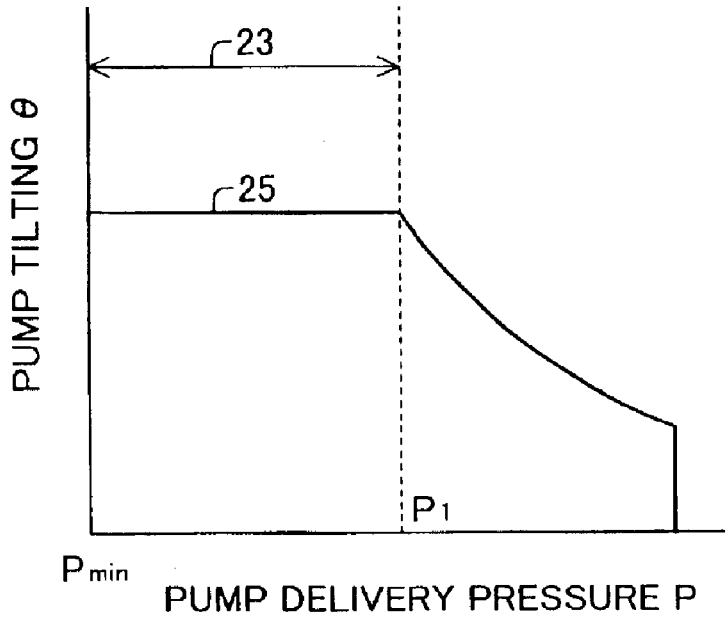
FIG. 16A is a graph showing the relationship between a pump delivery pressure P and a pump tilting θ in a prior-art system including an engine controlled in a governor region based on a reverse drooping characteristic.
Figure 16B:
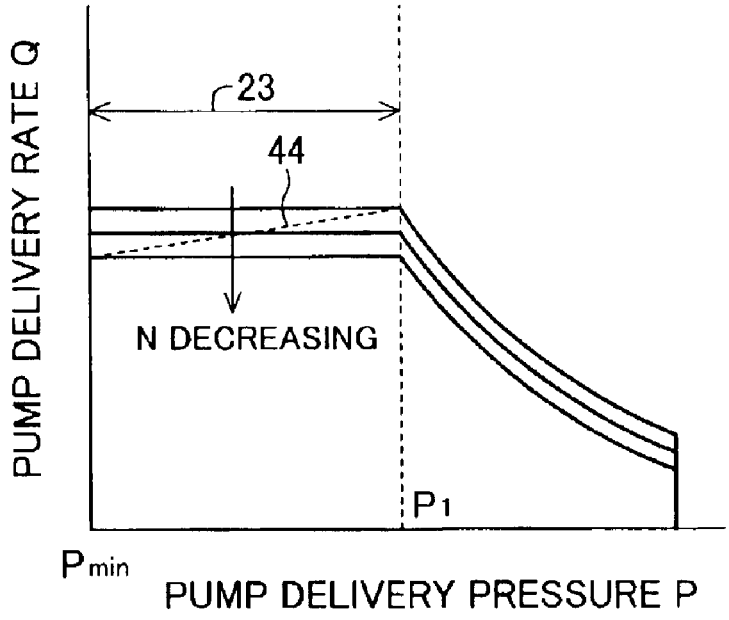
FIG. 16B is a graph showing the relationship between the pump delivery pressure and the pump delivery rate in the prior-art system.

FIGS. 16A and 16B show, respectively, the relationship between a pump delivery pressure P and a pump tilting θ and the relationship between a pump delivery pressure and a pump delivery rate in a prior-art system including an engine controlled in a governor region based on a reverse drooping characteristic.

In the case in which the tilting-angle modification value computing section 83, the switching section 84, and the adder 85, shown in FIG. 6, are not included as the processing functions of a working machine controller, the pump tilting θ is constant as represented by the straight line 25 in the range 23 between Pmin and P1 corresponding to the governor region 33. On the other hand, based on the reverse drooping characteristic, the engine revolution speed N is decreased as the engine output torque (engine load) Te reduces, as represented by the straight line 34 in FIG. 12. In the range 23 between Pmin and P1, therefore, the engine revolution speed N is decreased as the pump delivery pressure P lowers from P1. Hence, in spite of the pump tilting θ being constant, the pump delivery rate Q is reduced with a decrease of the engine revolution speed N, as represented by a broken line 44. Consequently, the flow rate of the hydraulic fluid supplied to the hydraulic actuator is reduced, thus resulting in the problem that the working speed in the no-load operation is further reduced in comparison with that in the isochronous control.

Figure 17A:
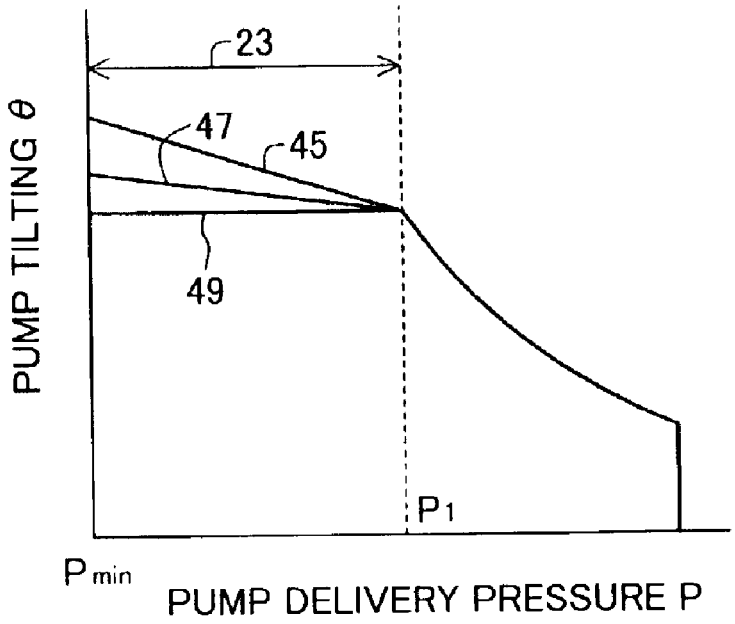
FIG. 17A is a graph showing the relationship between a pump delivery pressure P and a pump tilting θ in the second embodiment.
Figure 17B:
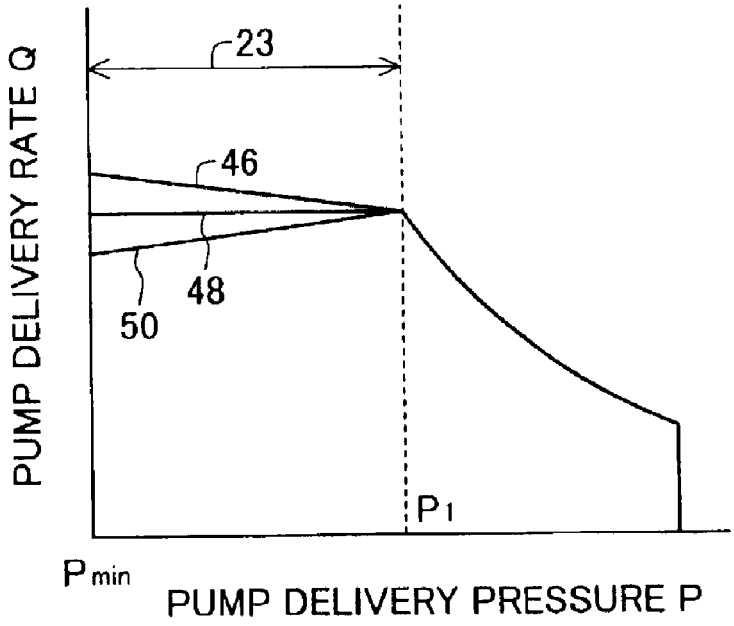
FIG. 17B is a graph showing the relationship between a pump delivery pressure and a pump delivery rate in the second embodiment.

FIGS. 17A and 17B show, respectively, the relationship between the pump delivery pressure P and the pump tilting θ and the relationship between the pump delivery pressure and the pump delivery rate in this embodiment.

In this embodiment, when the modification value Sa computed by the first tilting-angle modification value computing section 83A is selected and the characteristic line 19 shown in FIG. 15 is modified to the characteristic line 40, the pump tilting θ is changed as represented by a straight line 45 corresponding to the characteristic line 40 in FIG. 15 and the pump delivery rate Q is changed as represented by a straight line 46 with an increase of the pump tilting θ in the range 23 between Pmin and P1 corresponding to the governor region 33. Thus, in spite of the engine revolution speed N being reduced based on the reverse drooping characteristic, the pump delivery rate Q is linearly proportionally increased as the pump delivery pressure P lowers from P1. As a result, similarly to the prior-art system shown in FIGS. 10A and 10B, the flow rate of the hydraulic fluid supplied to the hydraulic actuator is increased, whereby the working speed in the no-load operation can be increased and the working efficiency can be improved.

Also, when the modification value Sb computed by the second tilting-angle modification value computing section 83B is selected and the characteristic line 19 shown in FIG. 15 is modified to the characteristic line 41, the pump tilting θ is changed as represented by a straight line 47 corresponding to the characteristic line 41 in FIG. 15 and the pump delivery rate Q is given as represented by a straight line 48 with an increase of the pump tilting θ in the range 23 between Pmin and P1 corresponding to the governor region 33. Thus, in spite of the engine revolution speed N being reduced based on the reverse drooping characteristic, a resulting decrease of the pump delivery rate Q is cancelled by an increase of the pump tilting so that the pump delivery rate Q is controlled to be held constant. Accordingly, in the case of performing the operation or work, such as traveling, load lifting or ground leveling, in which it is not desired to perform the control for increasing the delivery rate of the hydraulic pump 2, the hydraulic actuator can be operated at a constant speed in spite of an increase or decrease of the engine load. As a result, the traveling operation, the load lifting work and the ground leveling work can be satisfactorily performed.

When the modification value S=0 is selected by the 0-setting section 83C and the characteristic line 19 shown in FIG. 15 is not modified, the pump tilting θ is held constant as represented by a straight line 49 corresponding to the characteristic line 19 in FIG. 15 and the pump delivery rate Q is reduced as represented by a straight line 50 with a decrease of the pump tilting θ due to a reduction of the engine revolution speed N based on the reverse drooping characteristic, as with the case of FIG. 16B, in the range 23 between Pmin and P1 corresponding to the governor region 33. As a result, the fuel consumption can be further reduced.

This embodiment having the construction described above can also provide similar advantages to those obtainable with the first embodiment in the hydraulic drive system including the engine controlled based on the reverse drooping characteristic. More specifically, by shifting the mode selection switch 17A to the first position and selecting the modification value Sa computed by the first tilting-angle modification value computing section 83A, the pump delivery rate Q can be gradually increased even in the governor region 33 as the engine load reduces. In other words, an increase of the pump delivery rate can be achieved substantially comparably to an increase of the flow rate in the mechanical governor based on the drooping characteristic. Hence, the hydraulic actuator speed at a small engine load can be increased and the working efficiency at a small load, e.g., in no-load work, can be improved. Further, even an operator, who has been well experienced in operation of the working machine including the mechanical governor-equipped engine 1, can be given with a good operation feeling.

Also, in the case of performing the traveling operation, the load lifting work and the ground leveling work, by shifting the mode selection switch 17A to the second position and selecting the modification value Sb computed by the second tilting-angle modification value computing section 83B, the delivery rate of the hydraulic pump 2 is held constant regardless of the engine load, and the hydraulic actuator can be operated at a constant speed in spite of an increase or decrease of the engine load. Hence, the traveling operation, the load lifting work and the ground leveling work can be satisfactorily performed.

Further, with this embodiment, since the hydraulic pump 2 is driven using the engine controlled based on the reverse drooping characteristic, the engine revolution speed at a small load can be further reduced in comparison with that in the first embodiment using the engine controlled based on the isochronous characteristic, whereby even smaller fuel consumption and even less noise can be realized.

Moreover, in the case of performing light excavation with top priority given to fuel consumption, by shifting the mode selection switch 17A to the third position and selecting the set value S=0 from the 0-setting section 83C, the delivery rate of the hydraulic pump 2 is reduced and the fuel consumption can be further cut down.

A third embodiment of the present invention will be described with reference to FIGS. 18 to 20.

While in the above-described embodiment the present invention is applied to the hydraulic drive system including the engine controlled in the governor region based on the isochronous or reverse drooping characteristic, the characteristic in the governor region is not limited to that one. In this embodiment representing such one example, the present invention is applied to the hydraulic drive system including the engine controlled in the governor region based on a characteristic in combination of the isochronous characteristic and the reverse drooping characteristic.

Figure 18:
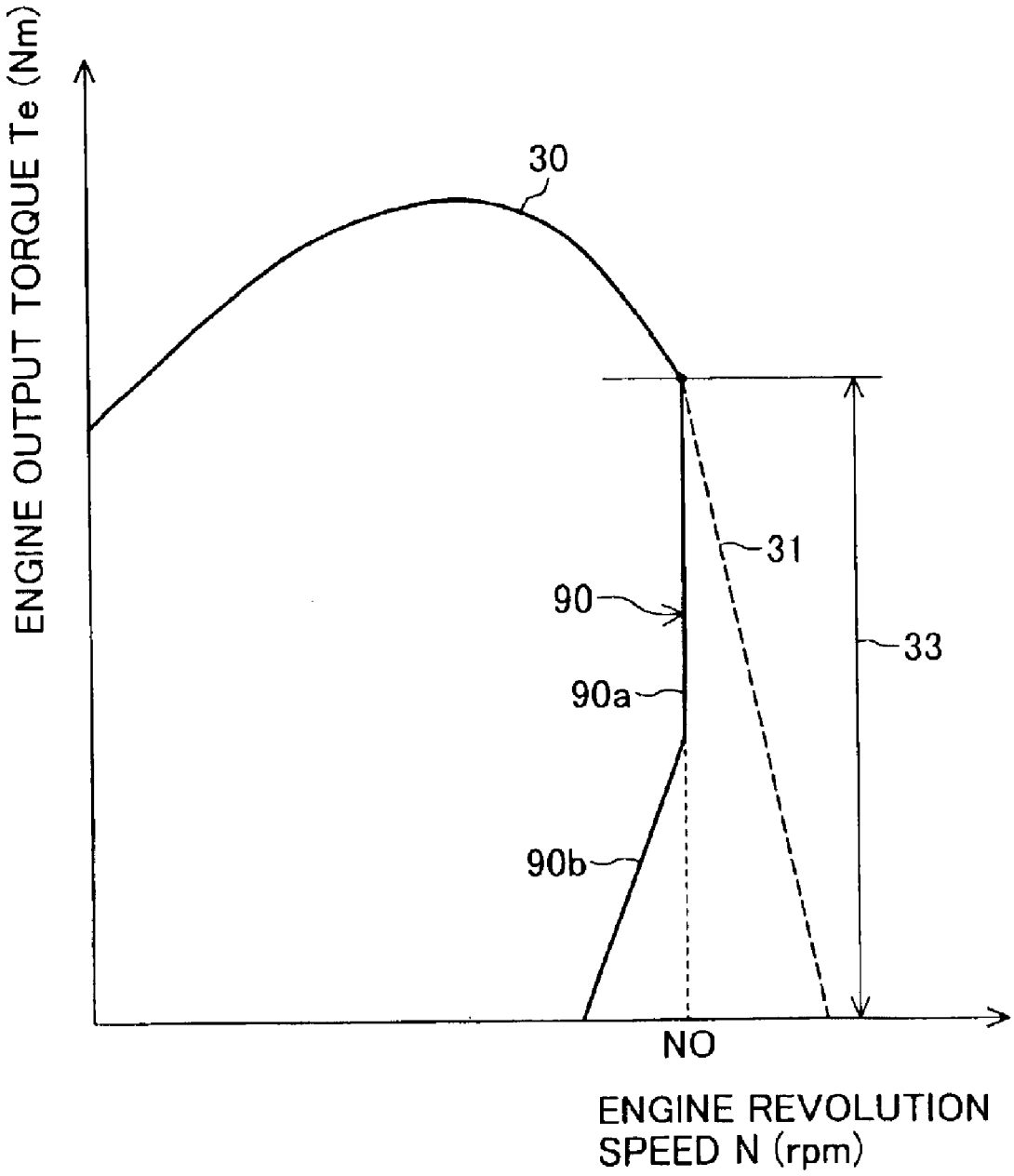
FIG. 18 is a characteristic graph showing the relationship between a revolution speed and an output torque of an engine equipped with an electronic governor performing control in combination of an isochronous characteristic and a reverse drooping characteristic according to a third embodiment of the present invention.

FIG. 18 shows the relationship between the revolution speed N and the output torque Te of the engine controlled in the governor region based on a characteristic in combination of the isochronous characteristic and the reverse drooping characteristic. Referring to FIG. 18, the governor region 33 has a characteristic 90 in combination of the isochronous characteristic that the engine revolution speed N is held at a constant value, i.e., a rated speed NO in spite of a decrease of the engine output torque Te (engine load), as represented by a straight line 90*a*, and the reverse drooping characteristic that the engine revolution speed N is reduced as the engine output torque Te decreases, as represented by a straight line 90*b*. According to the characteristic 90, the engine revolution speed can be held constant at a medium load based on the isochronous characteristic so that noise and fuel consumption are reduced while ensuring a certain actuator speed, and a further reduction of noise and fuel consumption can be realized based on the reverse drooping characteristic in the small-load operation in which the engine load is smaller than a medium value.

Figure 19:
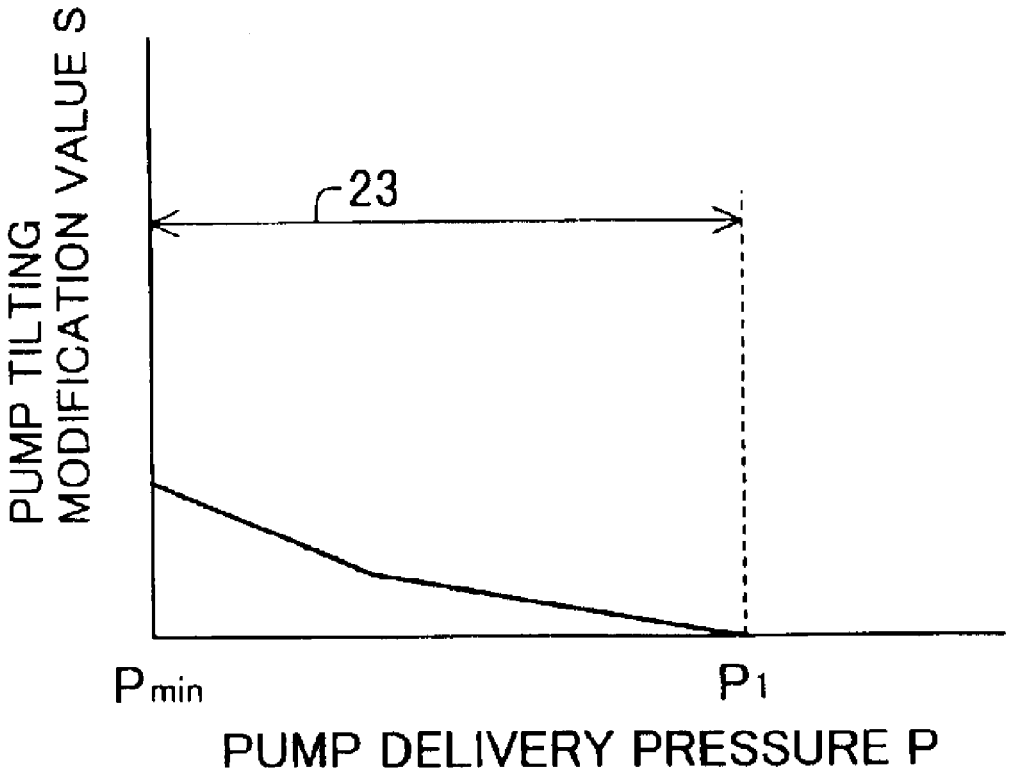
FIG. 19 is a graph showing the relationship between a pump delivery pressure and a pump tilting-angle modification value, which is used in a tilting-angle modification value computing section of a working machine controller.

FIG. 19 is a graph showing a characteristic of the pump tilting modification value S computed by the tilting-angle modification value computing section 83 (see FIG. 6) when the engine has the above-mentioned characteristic 90. The characteristic of the pump tilting modification value S is represented by a kinked line corresponding to the two characteristics of the straight lines 90*a* and 90*b* shown in FIG. 18.

Figure 20:
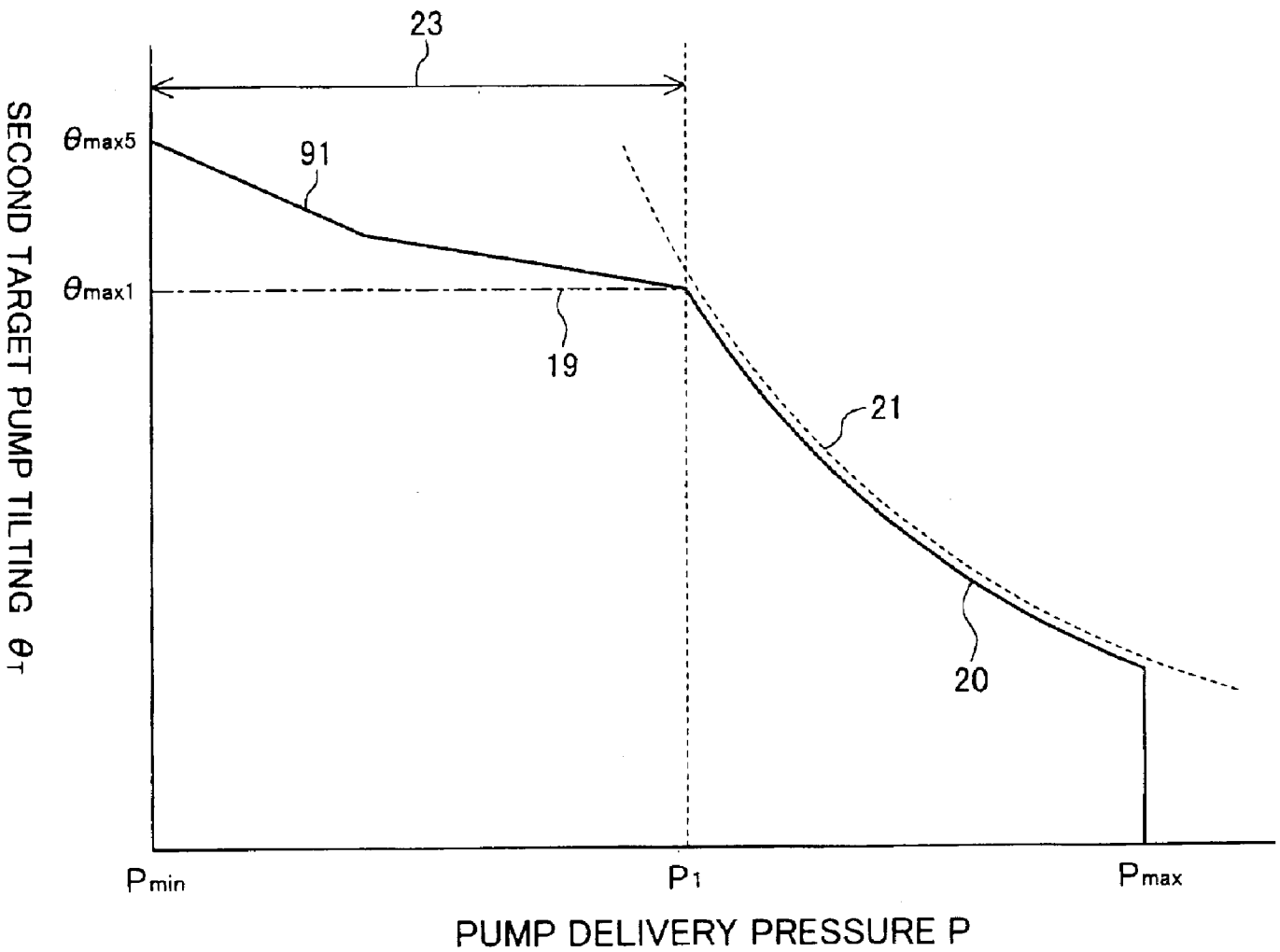
FIG. 20 is a graph showing the relationship between a delivery pressure signal and a second target tilting, which has been modified by an adder.

FIG. 20 is a characteristic graph showing the relationship between the delivery pressure signal and the second target tilting, similar to that of FIG. 9, but resulting when the modification value S computed by the tilting-angle modification value computing section 83 has the characteristic shown in FIG. 19. By adding the modification value S to the second target tilting θT, the characteristic line 19 is modified, as indicated by a characteristic line 91, to provide a characteristic represented by a kinked line similar to that representing the modification value S. In work such as heavy excavation in which the tilting angle of the hydraulic pump 2 is limited to the second target tilting θT, therefore, the pump tilting θ is changed as represented by a characteristic line 91 and the delivery rate of the hydraulic pump is changed as represented by the straight line 36, shown in FIG. 11B, in the range 23 between Pmin and P1 corresponding to the governor region 33. Hence, the control for increasing the pump delivery rate can be performed as with the first embodiment.

While, in the above-described embodiments, the characteristic of the modification value S for increasing the pump delivery rate at a small engine load, at which the pump delivery pressure P is not larger than P1, is set to be able to perform the control for increasing the pump delivery rate substantially in match with the drooping characteristic in the mechanical governor, the present invention is not limited to setting of such a delivery rate characteristic. For example, the gradient of the characteristic line representing the pump tilting modification value S, shown in FIG. 8, may be set so that the pump delivery rate is increased at a larger rate than that based on the drooping characteristic, or vice versa. Also, even when the governor region has a characteristic not in combination of the isochronous characteristic and the reverse drooping characteristic, the characteristic line representing the pump tilting modification value S, shown in FIG. 8, may be set to a kinked line. Further, the characteristic line representing the pump tilting modification value S may be a curved line instead of a straight line.

While, in the above-described embodiments, the pump delivery pressure, at which the modification value S is set to 0, is matched with P1, i.e., the pressure for staring the control in accordance with the pump absorption torque curve 20, it may be set to a value lower than P1.

Moreover, in the above-described embodiments, the characteristic of the modification value S for increasing the pump delivery rate at a small engine load, at which the pump delivery pressure P is not larger than P1, is set to a single characteristic corresponding to the drooping characteristic. However, one or plural characteristics may be set in addition to that corresponding to the drooping characteristic so that the operator can select one of those characteristics by shifting a mode selection switch. As an alternative, the mode selection switch may be of the dial type capable of changing its output continuously so as to vary the characteristic of the modification value S in a continuous manner. This enables a working machine to have plural kinds of operation performance and allows the operator to select the desired operating speed by himself while maintaining the advantageous merits of the isochronous characteristic or the reverse drooping characteristic, i.e., lower fuel consumption and less noise.

While, in the above-described embodiments, an actuator section of the fuel injection control unit capable of performing control based on the isochronous characteristic or the reverse drooping characteristic is constituted as the electronic governor 12, the present invention is not limited to it. A common rail type fuel injection control unit or a unit injector type fuel injection control unit may instead be provided which can control the amount of injected fuel regardless of the engine revolution speed.

Furthermore, in the above-described embodiments, command values for the tilting angle control of the hydraulic pump 2 depending on the demanded flow rate, the absorption torque control (absorption horsepower control) of the hydraulic pump 2, and the control for increasing the tilting angle of the hydraulic pump, which is a feature of the present invention, are all computed by the working machine controller 18, and the tilting angle of the hydraulic pump is controlled by sending the control current signal to the regulator 16. However, a part of those control processes (e.g., the tilting angle control of the hydraulic pump 2 depending on the demanded flow rate and the absorption torque control (absorption horsepower control) of the hydraulic pump 2) may be hydraulically performed using a regulator. Additionally, while, in the above-described embodiments, the tilting angle of the hydraulic pump 2 is detected by the tilting angle sensor 15 and controlled via a feedback loop so that the tilting angle is matched with the target tilting angle, the tilting angle of the hydraulic pump may be controlled via an open loop without providing the tilting angle sensor 15.

INDUSTRIAL APPLICABILITY

According to the present invention, in a hydraulic drive system including an engine in which at least a part of a governor region can be controlled based on an isochronous characteristic, a reverse drooping characteristic, or a combined one of the isochronous characteristic and the reverse drooping characteristic, the delivery rate of an hydraulic pump can be increased even in the governor region as the engine load reduces. Therefore, the hydraulic actuator speed at a small engine load can be increased comparably to a system including a mechanical governor-equipped engine and the working efficiency at the small load can be improved.

Also, even an operator, who has been well experienced in operation of a working machine including the mechanical governor-equipped engine, can be given with a good operation feeling.

Further, according to the present invention, by selectively performing the control for holding constant the delivery rate of the hydraulic pump, certain hydraulic actuators can be operated at a constant speed in spite of an increase or decrease of the engine load. As a result, it is possible to satisfactorily perform the operation or work desired by the operator.

What is claimed is:

1. A hydraulic drive system for a working machine comprising:

an engine;

a fuel injection control unit for controlling an amount of fuel injected into said engine such that an output torque characteristic of the engine in at least a part of a governor region where the fuel injection amount is adjustable comprises an isochronous characteristic, a reverse drooping characteristic, or a combined isochronous characteristic and reverse drooping characteristic;

a variable displacement hydraulic pump driven by said engine; and a plurality of hydraulic actuators driven by a hydraulic fluid delivered from said hydraulic pump, wherein said hydraulic drive system comprises pump absorption torque control means for controlling a displacement of said hydraulic pump such that, when a delivery pressure of said hydraulic pump exceeds a first predetermined pressure (P1), an absorption torque of said hydraulic pump does not exceed a maximum output torque of said engine in said governor region; and flow rate compensation control means for controlling the displacement of said hydraulic pump such that, when the delivery pressure of said hydraulic pump is not higher than the first predetermined pressure (P1) and said output torque of the engine is within a range of said governor, the displacement of said hydraulic pump is increased as the delivery pressure of said hydraulic pump lowers from a second predetermined pressure (P1) and the output torque of said engine is reduced.

2. A hydraulic drive system for a working machine comprising:

an engine;

a fuel injection control unit for controlling an amount of fuel injected into said engine such that an output torque characteristic of the engine in at least a part of a governor region where the fuel injection amount is adjustable comprises an isochronous characteristic, a reverse drooping characteristic, or a combined isochronous characteristic and reverse drooping characteristic;

a variable displacement hydraulic pump driven by said engine; and a plurality of hydraulic actuators driven by a hydraulic fluid delivered from said hydraulic pump, wherein said hydraulic drive system comprises a regulator for controlling a displacement of said hydraulic pump;

a pressure sensor for detecting a delivery pressure of said hydraulic pump;

pump absorption torque control means for controlling said regulator such that, when the delivery pressure of said hydraulic pump detected by said pressure sensor exceeds a first predetermined pressure (P1), an absorption torque of said hydraulic pump does not exceed a maximum output torque of said engine in said governor region; and flow rate compensation control means for controlling said regulator such that, when the delivery pressure of said hydraulic pump is not higher than the first predetermined pressure (P1) and said output torque of the engine is within a range of said governor region, the displacement of said hydraulic pump is increased as the delivery pressure of said hydraulic pump lowers from a second predetermined pressure (P1) and the output torque of said engine is reduced.

3. A hydraulic drive system for a working machine according to claim 1, wherein said second predetermined pressure (P1) is matched with said first predetermined pressure (P1).

4. A hydraulic drive system for a working machine according to claim 1, further comprising control release means for making ineffective the control for increasing the displacement of said hydraulic pump executed by said flow rate compensation control means.

5. A hydraulic drive system for a working machine according to claim 4, wherein said fuel injection control unit controls the fule injection amount such that said output torque characteristic of the engine in at least a part of a governor region comprises said isochronous characteristic, and said control release means includes at least one of a travel mode switch, a load lifting mode switch, and a ground leveling mode switch.

6. A hydraulic drive system for a working machine according to claim 1, wherein said flow rate compensation control means controls the displacement of said hydraulic pump such that the delivery rate of said hydraulic pump is increased as the delivery pressure of said hydraulic pump lowers from the second predetermined pressure (P1).

7. A hydraulic drive system for a working machine according to claim 1, wherein said fuel injection control unit controls the fuel injection amount such that said output torque characteristic of the engine in at least a part of a governor region comprises said isochronous characteristic, and said flow rate compensation control means comprises first means for controlling the displacement of said hydraulic pump such that the delivery rate of said hydraulic pump is increased as the delivery pressure of said hydraulic pump lowers from the second predetermined pressure (P1), second means for controlling the displacement of said hydraulic pump such that the delivery rate of said hydraulic pump is held constant when the delivery pressure of said hydraulic pump lowers from the second predetermined pressure (P1), and selecting means for selecting one of said first means and said second means.

8. A hydraulic drive system for a working machine according to claim 7, wherein said flow rate compensation control means further comprises third means for making ineffective the control for increasing the displacement of said hydraulic pump, and said selecting means selects one of said first means, said second means and said third means.

9. A hydraulic drive system for a working machine according to claim 1, wherein said pump absorption torque control means has means for computing a target displacement (θT) for said absorption torque control of the hydraulic pump from the delivery pressure of said hydraulic pump and a preset pump absorption torque curve, and holding said target displacement at a constant value (θmax1) when the delivery pressure of said hydraulic pump is not higher than the first predetermined pressure (P1), and said flow rate compensation control means comprises means for computing a displacement modification value (S) that is increased as the delivery pressure of said hydraulic pump lowers from the second predetermined pressure (P1), and means for computing a modified second displacement (θT) by adding said displacement modification value to said target displacement, the displacement of said hydraulic pump being controlled in accordance with said modified target displacement.

10. A hydraulic drive system for a working machine according to claim 1, wherein said pump absorption torque control means is means for limiting a maximum value of the displacement of said hydraulic pump to be not larger than the output torque of said engine in said governor region, and said flow rate compensation control means is means for controlling the maximum value of the displacement of said hydraulic pump such that the maximum value is increased as the delivery pressure of said hydraulic pump lowers from the second predetermined pressure.

11. A hydraulic drive system for a working machine according to claim 1, further comprising first computing means for computing a first target displacement (θD) depending on demanded flow rates of said plurality of hydraulic actuators, wherein said pump absorption torque control means has second computing means for computing a second target displacement for said absorption torque control of the hydraulic pump from the delivery pressure of said hydraulic pump and a preset pump absorption torque curve, and holding said target displacement at a constant value (emax1) when the delivery pressure of said hydraulic pump is not higher than the first predetermined pressure (P1), and said flow rate compensation control means comprises means for computing a displacement modification value (S) that is increased as the delivery pressure of said hydraulic pump lowers from the second predetermined pressure (P1), and means for computing a modified second target displacement (θT) by adding said displacement modification value to said second target displacement, the displacement of said hydraulic pump being controlled by selecting smaller one of said first target displacement and said modified second target displacement as a target displacement for control.

12. A hydraulic drive method for a working machine comprising:

an engine;

a fuel injection control unit for controlling an amount of fuel injected into said engine such that an output torque characteristic of the engine in at least a part of a governor region where the fuel injection amount is adjustable comprises an isochronous characteristic, a reverse drooping characteristic, or a combined isochronous characteristc and reverse drooping characteristic;

a variable displacement hydraulic pump driven by said engine; and a plurality of hydraulic actuators driven by a hydraulic fluid delivered from said hydraulic pump, wherein when a delivery pressure of said hydraulic pump exceeds a first predetermined pressure (P1), a displacement of said hydraulic pump is controlled such that an absorption torque of said hydraulic pump does not exceed a maximum output torque of said engine in said governor region, and when the delivery pressure of said hydraulic pump is not higher than the first predetermined pressure and said output torque of the engine is within a range of said governor region, the displacement of said hydraulic pump is controlled such that the displacement of said hydraulic pump is increased as the delivery pressure of said hydraulic pump lowers from a second predetermined pressure (P1) and the output torque of said engine is reduced.

13. A hydraulic drive method for a working machine according to claim 12, wherein when the delivery pressure of said hydraulic pump is not higher than the first predetermined pressure (P1), one of the control for increasing the displacement of said hydraulic pump as the delivery pressure of said hydraulic pump lowers from the second predetermined pressure (P1) and control for holding the displacement of said hydraulic pump constant is selectable.

14. A hydraulic drive method for a working machine according to claim 12, wherein when the delivery pressure of said hydraulic pump is not higher than the first predetermined pressure (P2), the displacement of said hydraulic pump is controlled such that a delivery rate of said hydraulic pump is increased as the delivery pressure of said hydraulic pump lowers from the second predetermined pressure (P1).

15. A hydraulic drive method for working machine according to claim 12, wherein said fuel injection control unit controls the fuel injection amount such that said output torque characteristic of the engine in at least a part of a governor region comprises said reverse drooping characteristic, and when the delivery pressure of said hydraulic pump is not higher than the first predetermined pressure (P1), one of the control for increasing the displacement of said hydraulic pump such that the delivery rate of said hydraulic pump is increased as the delivery pressure of said hydraulic pump lowers from the second predetermined pressure (P1), and control for increasing the displacement of said hydraulic pump such that the delivery rate of said hydraulic pump is held constant as the delivery pressure of said hydraulic pump lowers from the second predetermined pressure (P1) is selectable.

16. A hydraulic drive system for a working machine according to claim 1, wherein said first predetermined pressure (P1) is a value of a crossing point of a characteristic line of the maximum pump displacement (max1) determined by design specifications of said plurality of actuators and a preset pump absorption torque curve preset correspondingly to the maximum output torque of said engine in said governor region in a characteristic diagram which determines a relation between said pump delivery pressure and a target displacement (T).

17. A hydraulic drive system for a working machine according to claim 1, wherein said first predetermined pressure (P1) is a value corresponding to a maximum pressure in a range of said pump delivery pressure corresponding to said governor region.

18. A hydraulic drive method for a working machine according to claim 12, wherein said first predetermined pressure (P1) is a value of a crossing point of a characteristic lie of the maximum pump displacement (maxl) determined by design specifications of said plurality of actuators and a preset pump absorption torque curve preset correspondingly to the maximum output torque of said engine, in a characteristic diagram which determines a relation between said pump delivery pressure and a target displacement (T).

19. A hydraulic drive method for a working machine according to claim 12, wherein said first predetermined pressure (P1) is a value corresponding to a maximum pressure in a range of said pump delivery pressure corresponding to said governor region.

20. A hydraulic drive system for a working machine comprising:

an engine;

a fuel injection control unit for controlling an amount of fuel injected into said engine such that an output torque characteristic of the engine in at least a part of a governor region where the fuel injection amount is adjustable comprises an isochronous characteristic, a reverse drooping characteristic, or a combined isochronous characteristic and reverse drooping characteristic;

a variable displacement hydraulic pump driven by said engine; and a plurality of hydraulic actuators driven by a hydraulic fluid delivered from said hydraulic pump; and wherein said hydraulic drive system comprises pump absorption torque control means for controlling a displacement of said hydraulic pump such that, when a delivery pressure of said hydraulic pump increases, an absorption torque of said hydraulic pump does not exceed a maximum output torque of said engine in said governor region; and flow rate compensation control means for controlling the displacement of said hydraulic pump such that, when the absorption torque of said hydraulic pump is within a range of said governor region, the displacement of said hydraulic pump is increased as the delivery pressure of said hydraulic pump lowers.

* * * * *